US005309988A

United States Patent [19]

Shy et al.

[11] Patent Number: 5,309,988

[45] Date of Patent: May 10, 1994

[54] ELECTROMECHANICAL SHIFTER APPARATUS FOR SUBSURFACE WELL FLOW CONTROL

[75] Inventors: Perry C. Shy, Arlington; William R. Welch, Carrollton, both of Tex.

[73] Assignee: Halliburton Company, Houston, Tex.

[21] Appl. No.: 984,179

[22] Filed: Nov. 20, 1992

[51] Int. Cl.[5] ..... E21B 23/00

[52] U.S. Cl. ..... 166/72; 166/237

[58] Field of Search ..... 166/72, 120, 298, 332, 166/214, 373, 375, 381

[56] References Cited

U.S. PATENT DOCUMENTS

| | | | |
|---|---|---|---|
| 3,051,243 | 8/1962 | Grimmer et al. | 166/224 |
| 3,552,718 | 1/1971 | Schwegman | 166/332 X |
| 3,848,668 | 11/1974 | Sizer et al. | 166/72 |
| 3,871,447 | 3/1975 | Crowe | 166/120 |
| 3,871,456 | 3/1975 | Sizer et al. | 166/72 |
| 4,436,152 | 3/1984 | Fisher, Jr. et al. | 166/214 |
| 4,574,883 | 3/1986 | Carroll et al. | 166/72 |
| 5,090,481 | 2/1992 | Pleasants et al. | 166/373 |
| 5,141,053 | 8/1992 | Restarick et al. | 166/120 |
| 5,205,355 | 4/1993 | Gay et al. | 166/72 |
| 5,226,483 | 7/1993 | Williamson, Jr. | 166/375 |

*Primary Examiner*—Ramon S. Britts
*Assistant Examiner*—Frank S. Tsay
*Attorney, Agent, or Firm*—Tracy W. Druce; J. Richard Konneker

[57] ABSTRACT

A subsurface well flow control system includes a series of movable sleeve type flow control devices installed in a well flow conductor at various fluid-containing fracture zones, and a shifter tool movable through the conductor and operable to selectively shift any selected number of the sleeve portions of the flow control devices, in either direction between their open and closed positions, without removing the tool from the conductor. Radially retractable anchor and shifter key sets are carried in side wall openings of the tool body, and are respectively configured to be lockingly engaged with interior side surface groove sets on the body and movable sleeve portions of any of the flow control devices. The key sets are spring-biased radially outwardly toward extended positions, and an electromechanical drive system disposed within the tool body is operative to radially retract the key sets, and to axially drive the shifter key set toward or away from the anchor key set. This permits the tool to be moved into and through any of the flow control devices in either axial direction, locked to the device, operated to shift its sleeve portion fully or partially in either direction, and then disengaged from the flow control device and moved to any other one of the flow control devices to shift its sleeve portion. Interengaged V-threads on the body and sleeve portions of each flow control device facilitate the releasable retention of the sleeve portion in a partially shifted position.

33 Claims, 11 Drawing Sheets

ELECTROMECHANICAL SHIFTER APPARATUS FOR SUBSURFACE WELL FLOW CONTROL

BACKGROUND OF THE INVENTION

The present invention relates generally to well tools, and more particularly relates to shifter tools used to selectively engage and operatively manipulate movable sleeve type flow control devices installed in a subsurface flow conductor at spaced production zones in a well.

In order to increase well production capacity and efficiency, the borehole of a modern subsurface well is often extended both vertically and horizontally through spaced series of subsurface production fracture zones containing retrievable production fluid such as oil and/or natural gas. Wells of this type are conventionally referred to as "offset" wells and typically have a generally vertical initial borehole section extending downwardly from the surface, and a lower borehole end section which is angled relative to the initial borehole section and in some instances may be generally horizontally disposed or even turn slightly upwardly.

The offset borehole, as in the case of a generally straight borehole is conventionally lined with a concreted casing having longitudinally spaced side wall perforations aligned with the fracture zones. In some wells the concreted casing by itself defines a well flow conductor for upwardly flowing production fluid, received from one or more of the fracture zones, to the surface. In other wells the flow conductor portion is defined by metal production tubing coaxially disposed within the casing. Fracture zone fluid entering the production tubing is flowed upwardly therethrough.

To selectively initiate and terminate fluid flow into the conductor portion of a subsurface well from the spaced apart fracture zones therein it is common practice to install a sliding sleeve type flow control device in the well flow conductor at each fracture zone. When the concreted wellbore casing defines the fluid conductor portion of the well, the flow control devices are installed directly in the casing. When production tubing defines the flow conductor portion of the well, the flow control devices are installed in the production tubing in alignment with casing side wall perforations in turn aligned with the fracture zones.

As conventionally manufactured, the typical sliding sleeve type flow control device comprises a generally tubular body portion having side wall inlet openings formed therein, and a tubular flow control sleeve coaxially and slidably disposed within the body portion for axial movement relative thereto between a closed position in which the sleeve blocks the body inlet ports, and an open position in which the sleeve uncovers the ports to permit fluid to flow inwardly therethrough into the interior of the body and thus into the interior of the well flow conductor—i.e., the borehole casing or production tubing as the case may be. The sliding sleeves thus function as movable valve elements operable to selectively permit and preclude fluid inflow to their associated flow control device body portions.

Generally cylindrical shifter tools, coaxially lowered into the interior of the well flow conductor, are conventionally utilized to shift selected ones of the sliding sleeves from their closed positions to their open positions, or vice versa, to provide subsurface flow control in the well. Under conventional practice, to effect this sleeve shifting the interior side surfaces of the sleeves have formed therein longitudinally spaced series of annular, transverse notches, and the shifter tool removably carries thereon a key set which is one of a series of key sets provided for interchangeable use on the tool.

Each sleeve interior side surface notch set has a pattern different than the interior notch set patterns on all of the other sliding sleeves and is configured to receive and lockingly mate with the correspondingly notched exterior side surface profile of only one of the key sets. The particular key set removably carried by the shifter tool is resiliently biased, in a direction perpendicular to the longitudinal axis of the tool, toward a normal or "seeking" position in which the notched side profile area of the key set projects outwardly beyond the exterior side surface of the tool body.

As the tool is coaxially lowered through the well flow conductor, and through nonmating sleeves toward its intended mating sleeve target, the notch sets of the nonmating sleeves successively cam the key set inwardly from its seeking position as the key set passes through the sleeves, but do not lockingly mate with the key set. When the key set is brought into longitudinal alignment with the target mating sleeve notch set the key set pops outwardly into locking engagement with the complementarily configured notch set, thereby locking the key set to the target sleeve. The coil tubing, upon the lower end of which the tool is carried, can then be pushed or pulled as needed to shift the target sleeve from one of its open and closed positions to the other position thereof.

While this conventional approach to subsurface flow control of a spaced series of production zones appears at first glance to be a relatively simple and straightforward one, it has proven to present a well known variety of problems, limitations and disadvantages. For example, in instances where the sliding sleeve flow control devices are disposed in a horizontal wellbore run (or other sharply deviated wellbore section) a wellbore length limit is typically reached at which the coil tubing cannot be downwardly pushed with enough force to effect its sleeve shifting tasks without buckling the coil tubing. The axial compression strength of the coil tubing thus becomes an undesirable, and unavoidable, limiting factor in the overall usefulness of this conventional key set/sliding sleeve subsurface well flow control system.

Another substantial disadvantage built into this conventional system is that in addition to the fact that each key set interchangeably mountable on the shifter tool "fits" only one of the sliding sleeves in the spaced series thereof, each key set is also "directional" relative to its single lockably mating sleeve.

More specifically, each key set is removably mountable on the tool in either of two opposite orientations relative to the tool. In one of these two opposite mounting orientations the key set can only lockingly engage its target sleeve when the key set is moving in one direction through the target sleeve. Correspondingly, in its reversed mounting orientation the key set can only lockingly engage its target sleeve when the key set is moving in the opposite direction through the target sleeve.

Each key set, in a selected orientation thereof, is mounted on the tool using a frangible release structure such as a shear pin. After the key set has been locked to its target sleeve, and the coil tubing has been pushed or pulled as needed to shift the sleeve to one of its open or closed limit positions within the flow control device body, it is necessary to push or pull the coil tubing with an even greater force to break the shear pin in order to disengage the key set from the sleeve and thereby permit the tool to be retrieved. This additional stress on the coil tubing, of course, undesirably limits the length to which it can be extended into an offset portion of a wellbore.

The combination of the directionality of these conventional key sets and the their frangible connection to the shifter tool tends to make the manipulation of the sliding sleeve flow control devices a tedious, time consuming, and relatively expensive task. To illustrate the potential magnitude of this problem one has only to envision a spaced number of sliding sleeve type flow control devices, say twenty, several thousand feet below the surface, each of the devices being representatively in its closed position.

The task of opening each of these twenty flow control devices, and subsequently returning them to their originally closed positions, requires a total of eighty tool trips along the length of the well flow conductor—twenty down and twenty up to open the devices, and twenty down and twenty up to later close the devices. Moreover, each of the forty times the shifter tool is brought to the surface its key set must be changed out and the broken shear pins replaced.

Because of the necessity of forcibly moving the target sleeve to one of its open and closed limit positions to break the key set shear pins and permit disengagement of the key set from the sleeve notch set, it is impossible with the conventional subsurface flow control system described above to only partially open or close any of the flow control device body inflow openings to make adjustments to the fluid inflow rate from a particular production zone into the well flow conductor—the fluid inflow openings in each device must either be fully blocked or fully uncovered. This disadvantage also, as a practical matter, precludes the possibility of incorporating both inlet ports and outlet ejection orifices into any of the flow control devices. Additionally, since the shifting tool (in a given trip down the well flow conductor) can only open or close its target sleeve, logging or other well inspection equipment, such as video cameras, cannot be operatively mounted on the lower end of the tool for use in conjunction therewith.

It can be readily seen from the foregoing that a need exists for improvements in subsurface well flow control systems, and associated shifter tool apparatus, of the general type described above. It is accordingly an object of the present invention to provide such improvements.

SUMMARY OF THE INVENTION

In carrying out principles of the present invention, in accordance with a preferred embodiment thereof, a specially designed shifter tool is provided for engaging and axially shifting a sleeve member coaxially and slidably retained within the hollow body portion of a movable sleeve type flow control device installed, in a subsurface well flow conductor, at a fluid-containing subsurface fracture zone.

The shifter tool has a generally tubular body axially insertable into the well flow conductor and longitudinally movable into the flow control device, the tool body having first and second axially spaced side wall opening means therein.

Anchor key means, releasably lockable with the flow control device body in a manner releasably locking the tool body thereto, are received in the first tool body side wall opening means for radial movement relative to the tool body between an extended position in which the anchor key means radially project outwardly beyond the tool body, and a retracted position in which the anchor key means are radially retracted into the first side wall opening means.

Shifter key means, releasably lockable with the flow control device movable sleeve member, are received in the second tool body side wall opening means for radial movement relative to the tool body between an extended position in which the shifter key means radially project outwardly beyond the tool body, and a retracted position in which the shifter key means are radially retracted into the second side wall opening means.

First drive means, disposed within the shifter tool body, resiliently bias the anchor and shifter key means outwardly toward their extended positions. Second drive means are also disposed within the shifter tool body, and are selectively operable to (1) radially drive the anchor and shifter key means from their extended positions to their retracted positions, and (2) axially drive the shifter key means toward and away from the anchor key means.

The shifter tool is preferably incorporated in a subsurface well flow control system in which a spaced series of the aforementioned movable sleeve type flow control devices are installed in the well flow conductor. The tubular body portions of the flow control devices have formed on their interior side surfaces identically configured groove means each adapted to lockingly receive, in a radially outward direction, the anchor key means portion of the tool.

The movable sleeve portions of the flow control devices have generally tubular configurations and are coaxially carried within the device bodies for driven axial movement relative thereto between closed positions in which the sleeves cover side wall fluid opening means in their associated flow control device bodies, and open positions in which the sleeves uncover such fluid opening means. Formed on the interior side surfaces of the sleeves are identically configured groove means each adapted to lockingly receive, in a radially outward direction, the shifter key means portion of the tool.

The provision on the tool of the radially retractable anchor and shifter key means, coupled with the ability of the anchor and shifter key means to respectively and lockingly engage the body and sleeve groove means of any of the flow control devices, permits the tool to be moved through any or all of the flow control devices and be releasably locked to the body and sleeve portions of any of the devices upon operatively entering the device from either axial direction. In turn, this ability of the tool permits it to be used to shift any selected number of the sleeves, fully or partially in either axial direction thereof, without removing the tool from the well flow conductor.

The shifting of a selected flow control sleeve is representatively effected by using the second drive means to retract the anchor and shifter key means, passing the tool body through nonselected flow control devices on its way to the target flow control device, permitting the first drive means to resiliently move the anchor and shifter key means outwardly to their extended positions as the tool approaches the target device, and then operatively positioning the anchor and shifter key means within the target device in a manner such that the anchor key means lockingly enter the target device body groove means, and the shifter key means lockingly enter the target device sleeve groove means.

The second drive means portion of the tool is then sequentially used to axially move the shifter key means relative to the anchor key means, thereby axially shifting the sleeve a predetermined distance and in a predetermined direction relative to its associated flow control device body, and then radially retract the anchor and shifter key means from the body and sleeve groove means, respectively, to disconnect the tool from the now adjusted flow control device. Importantly, the axial key means driving force is not borne by the structure (such as coil tubing) used to selectively raise and lower the shifter tool through the well flow conductor. While still in the well flow conductor, the disconnected tool may then be moved into one or more additional flow control devices to axially shift their sleeve portions in a similar fashion.

Load cell means and potentiometer means are preferably incorporated in the shifter tool body. The load cell means are operative to sense the magnitude of an axial driving force exerted on the shifter key means by the second drive means and responsively generate an electrical signal indicative of such driving force magnitude. The potentiometer means are operative to sense the distance between the anchor and shifter key means and responsively generate an electrical signal indicative of such distance.

These electrical signals are transmitted to the surface via appropriate wiring routed through the positioning means, representatively coil tubing, used to raise and lower the shifter through the well flow conductor. This permits continuous surface monitoring of both the driving force being exerted on the shifter key means, and the distance which a particular flow control device sleeve has been shifted by the tool.

To capitalize on the unique ability of the tool to only partially shift a flow control device sleeve between its fully open and fully closed limit positions, and then disengage from the partially shifted sleeve and its associated flow control device body, according to a further aspect of the present invention a specially designed movable sleeve type fluid flow control device is provided for incorporation in the subsurface flow control system.

The fluid flow control device includes a generally tubular body portion coaxially installable in the well flow conductor and having side wall opening means therein through which a fluid may flow, and a generally tubular sleeve member coaxially disposed within the body portion for driven axial shifting movement relative thereto in opposite directions between first and second limit positions. In its first limit position the sleeve member completely covers the body portion opening means and precludes fluid flow therethrough. In its second limit position the sleeve member completely uncovers the body portion opening means and permits fluid flow therethrough.

Cooperating means are provided on the flow control device body and sleeve portions for forcibly but releasably holding the sleeve in a selectively variable partially shifted position, intermediate its first and second limit positions, in which the sleeve only partially blocks the body portion opening means, the cooperating means being operative to provide a yieldable, generally ratchet-like resistance to axial movement of the sleeve relative to its associated flow control device body portion in opposite directions between its first and second limit positions.

In a preferred embodiment of the flow control device, its cooperating means include interengaged, axially extending series of V-threads formed on the outer side surface of the sleeve and the inner side surface of the flow control device body, and opening means extending transversely through an externally threaded portion of the sleeve and operative to increase the radial flexibility of the sleeve adjacent these opening means. Additionally, the opening means formed in the flow control device body include a fluid inlet port and an orificed fluid outlet injection port spaced axially apart from the fluid inlet port in a manner such that the sleeve may be shifted to uncover only the outlet injection port or the outlet injection port and the fluid inlet port.

In a preferred embodiment of the shifter tool, its first drive means include spring means operatively interposed between and engaging (1) interior portions of the tool and (2) the anchor and shifter key means. The anchor key means are carried on a first longitudinal portion of the tool body, and the shifter key means are carried on a second longitudinal port ion of the tool body that is axially movable in opposite directions toward and away from the first longitudinal body portion.

The second drive means portion of the shifter tool include first and second tubular retraction members coaxially disposed in the first and second longitudinal tool body portions, respectively, and having side wall slot means outwardly through which the anchor and shifter key means respectively extend. A first electric motor is anchored within the first longitudinal tool body portion, and a second electric motor is carried within the first longitudinal tool body portion for axial movement therein toward and away from the first electric motor.

Means are provided for interconnecting the first and second electric motors in a manner such that the second motor may be selectively shifted toward or away from the first motor in response to operation of the first motor. The second longitudinal tool body portion is secured to the second motor for axial movement therewith toward and away from the first motor. Means are additionally provided for drivingly coupling the first and second retraction members to the second motor in a manner such that operation of the second motor simultaneously rotates the first and second retraction members about their longitudinal axes.

When the retraction members are rotated in one direction, tapered side edge portions of their side wall slot means engage and inwardly cam base portions of the anchor and shifter key means to drive the anchor and shifter key means from their extended positions to their retracted positions against the resilient biasing force of the first drive means. When subsequently rotated in opposite directions by the second motor, the first and second retraction members release the first and second retraction members to permit the first drive means to return them to their extended positions.

A breakaway safety release mechanism is preferably incorporated in the shifter tool and is operative to permit the tool to be pulled outwardly from a flow control device when the anchor and shifter keys are lockingly engaged therewith and the retraction members for some reason cannot be rotated to retract the anchor and shifter key means from their extended locked positions within the flow control device.

The release mechanism comprises frangible means, such as shear pins, that axially and respectively lock the first and second retraction members to first and second key retainer portions of the shifter tool. The frangible means are operative to be broken, in response to an upward pull of the shifter tool while the anchor and shifter key means are respectively and lockingly engaged with the body and sleeve portions of the flow control device, to permit the first and second key retainer portions to be forcibly moved axially relative to the lockingly engaged anchor and shifter key means by the upward pulling of the shifter tool.

Cooperatively interengageably ramped surface means formed on the first and second key retainer portions and their associated anchor and shifter key means are operable, in response to forcible axial movement of the first and second key retainer portions relative to their associated anchor and shifter key means, to cause the first and second key retainer portions to respectively cam the anchor and shifter key means inwardly from their extended positions to their retracted positions, thereby permitting the shifter tool to be pulled axially outwardly from the flow control device.

The unique ability of the shifter tool to shift any selected number of the flow control device sleeves in either direction, irrespective of which direction the tool is brought into a flow control device, and without removing the tool from the well flow conductor, permits the tool to be used in several other unique manners heretofore unavailable with conventional key-type shifter tools.

For example, according to one aspect of the present invention, the tool may be used in conjunction with an inspection device (such as a logging tool or a video camera) to inspect well fluid disposed within a subsurface fracture zone at which a movable sleeve type flow control device is disposed. With the sleeve portion of the flow control device initially closed, the inspection device is operatively secured to the bottom end of the tool body and the tool body is lowered, bottom end first, through the well flow conductor on coil tubing until the inspection device passes through the flow control device and the anchor and shifter key means are aligned and lockingly engaged with the body and sleeve portions of the flow control device as previously described herein.

The tool is then used to drive the sleeve to an open position thereof and disengaged from the flow control device. Without removing the tool from the well flow conductor the tool is raised therein to bring the inspection device into proximity with the opened inlet ports of the flow control device to monitor well fluid flowing inwardly therethrough. When the inspection process is completed, the tool is lowered and operated to again close the sleeve.

Importantly, during the inspection process, the raised tool body functions to block upward fluid flow through the well flow conductor, and it is not necessary to remove the tool from the conductor, and then reinsert the tool into the conductor, to open and subsequently close the flow control device sleeve.

According to another aspect of the present invention, the shifter tool is used in a method of operating a movable sleeve type flow control device, installed in a subsurface well flow conductor, that incorporates the backwashing of the interior of the flow control device prior to using the tool to open the sleeve portion of the flow control device. Under this method, back pressure valve means are positioned on an upper end portion of the tool and are operative to forcibly discharge pressurized backwashing fluid flowed into the top tool end portion.

With the anchor and shifter key means portions of the tool retracted, a bottom end portion of the tool (including the anchor and shifter key means) is lowered through the closed flow control device to position the back pressure valve means above the device. Pressurized fluid is then discharged through the back pressure valve means to backwash the interior of the flow control device. The tool is then lifted to operatively position the anchor and shifter key means within the flow control device, and the tool is used to open the sleeve.

BRIEF DESCRIPTION OF THE DRAWINGS

FIGS. 6A-8A are cross-sectional views of the tool respectively similar to those shown in FIGS. 6-8, but with certain internal tool components having been operatively shifted to positions shown in FIGS. 9A-9G;

DETAILED DESCRIPTION

Figure 2A:
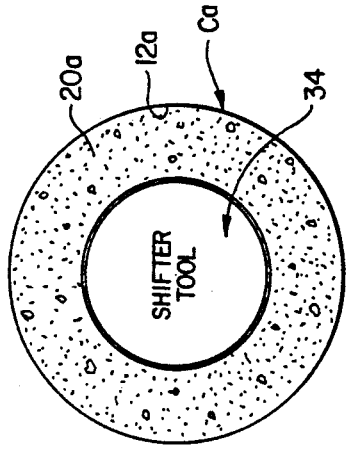
FIG. 2A is a cross-sectional view similar to that in FIG. 2 but depicting an alternate construction of the flow conductor portion of the well.
Figure 2:
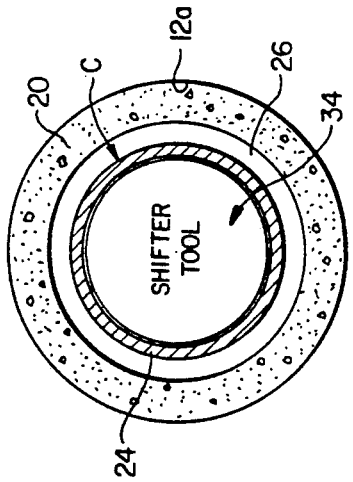
FIG. 2 is an enlarged scale cross-sectional view through the offset well portion.
Figure 1:
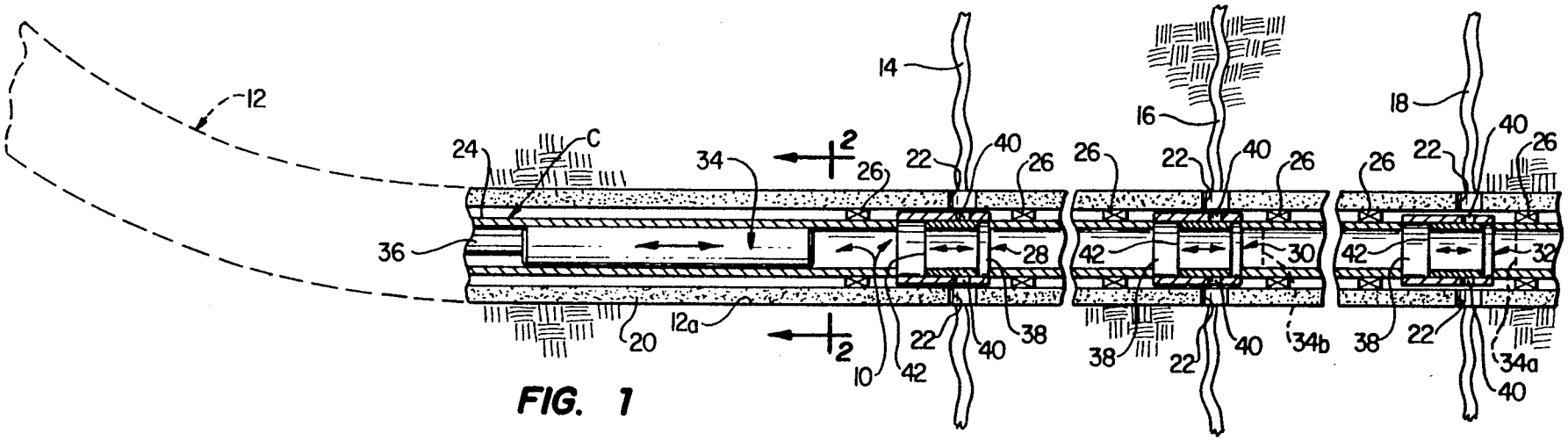
FIG. 1 is a horizontally foreshortened, highly schematic cross-sectional view through a generally horizontal subsurface portion of a representative offset well, and illustrates a shifter tool embodying principles of the present invention and used to selectively engage and operatively manipulate movable sleeve type flow control devices disposed in the flow conductor portion of the well at horizontally spaced apart production zones therein.

Schematically illustrated in FIGS. 1 and 2, in cross-section, is a portion of a subsurface well flow control system 10 embodying principles of the present invention and disposed within a representatively horizontal section 12*a* of the borehole 12 of an offset well. Horizontal borehole section 12*a*, which has been longitudinally foreshortened for illustrative purposes, sequentially passes through a spaced series of vertical fracture zones, including the illustrated zones 14, 16 and 18, each containing a retrievable production fluid such as oil and/or natural gas.

Borehole 12 is conventionally lined with a concreted casing 20 having side wall perforations 22 therein aligned with the fracture zones 14, 16 and 18. Coaxially disposed within the casing 20 is the usual metal production tubing 24 which defines a well flow conductor C serving to receive production fluid from the vertical fracture zones and flow the received fluid to the surface of the well. A longitudinally spaced series of annular packer members 26 circumscribe the production tubing 24 within casing 20, with longitudinally adjacent pairs of packer members serving to externally seal off end portions of a production tubing length on opposite sides of one of the vertical fracture zones 14, 16 and 18.

For purposes of descriptive clarity, a very general discussion of the structure and operation of the flow control system 10 will now be presented with reference to the highly schematic drawing FIGS. 1 and 3A–3C. Following such general discussion, a detailed description of both the structure and operation of system 10 will be provided.

Basically speaking, flow control system 10 comprises a longitudinally spaced series of specially designed movable sleeve type flow control devices, including the illustrated flow control devices 28, 30 and 32, and a uniquely operative, generally tubular shifter tool 34 coaxially disposed within the production tubing 24 for axial movement along its length. The shifter tool 34 is supported at its left or upper end on the lower end of a length of coil tubing 36 inserted downwardly into the production tubing 24. By appropriately pushing or pulling on the coil tubing 36 the tool 34 may be moved in selectively opposite directions along the interior length of the production tubing 24 and through the flow control devices installed therein.

Flow control devices 28,30,32 are respectively positioned at the vertical fracture zones 14,16,18 between packers 26 disposed on opposite sides of such fracture zones. Each flow control device has a tubular body portion 38 coaxially installed in the production tubing 24 (and thus in the well flow conductor C) and having side wall fluid inlet ports 40 communicating with the casing perforations 22 at the vertical fracture zone with which the particular flow control device is operatively associated. In the event that a well casing 20*a* (see FIG. 2A) defines by itself a well flow conductor Ca (i.e., where production tubing 24 is not installed) the flow control device bodies 38 would be installed directly in the casing 20*a*, with the body inlet ports 40 appropriately communicated with the fracture zones.

Coaxially and slidably disposed in each of the flow control device bodies 38 is a sleeve structure 42 that may be axially shifted relative to the body 38 between its illustrated closed position in which the sleeve blocks the body inlet ports 40 to preclude fluid flow therethrough, and an open position in which the sleeve uncovers ports 40 to permit fluid flow therethrough.

Figure 3A:
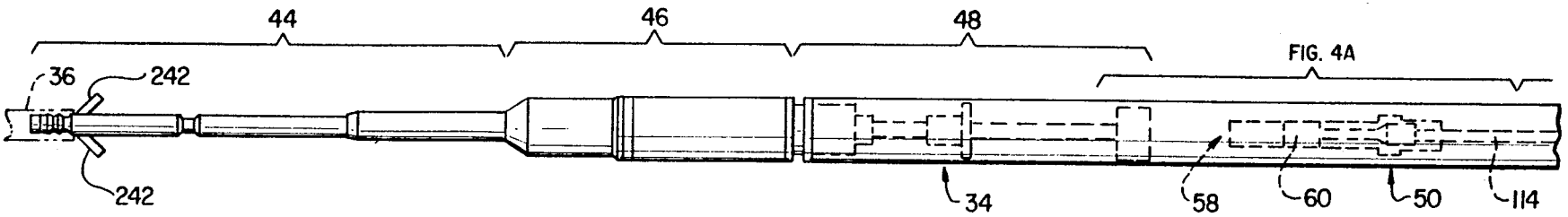
FIGS. 3A-3C are enlarged scale continuation side elevational views of the shifter tool, with certain internal tool components being shown in phantom.
Figure 3B:
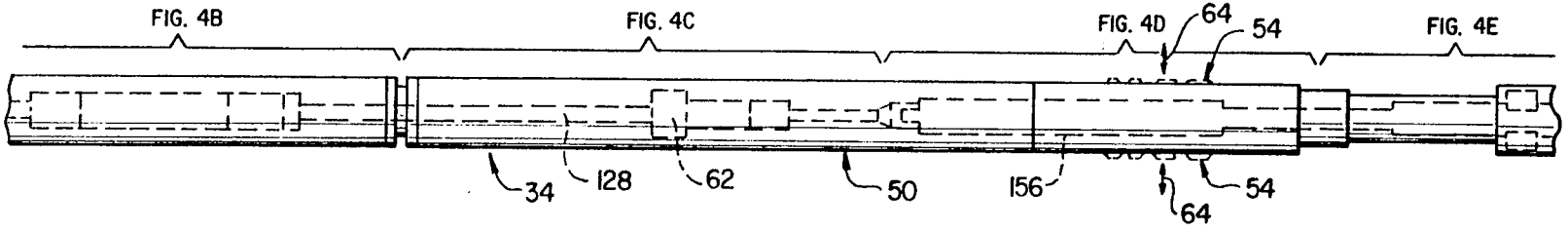
Figure 3C:
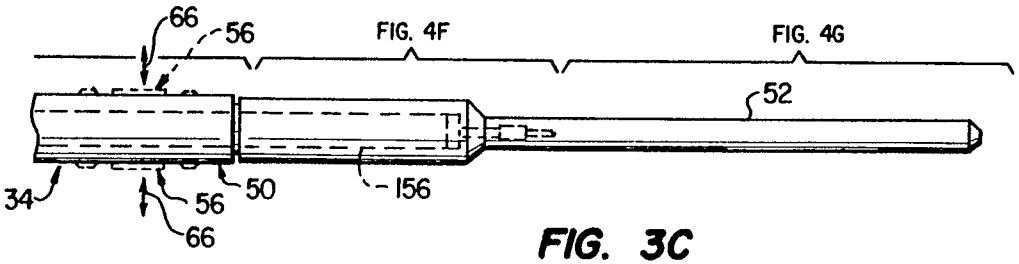

From left to right in FIGS. 3A–3C, the shifter tool 34 has a coil tubing cable head section 44 secured to the lower end of the coil tubing 36, a crossover section 46, and a pressure compensation section 48. These three longitudinal sections of the shifter tool 34 are of conventional construction and operation. The balance of the tool comprises a specially designed key drive section 50. For purposes later described, an inspection device in the form of a cylindrical logging tool 52 is connected to the right or lower end of the key drive section 50.

Carried on the drive section 50 are a diametrically opposite pair of anchor keys 54 (see FIG. 3B), and a diametrically opposite pair of shifter keys 56 (see FIG. 3C) spaced rightwardly apart from the keys 54. An electromechanical drive system 58 disposed in the tool body section 50, including an electric translator motor 60 and an electric rotator motor 62, is operative in a manner subsequently described to radially retract or extend the keys 54,56 as indicated by the double-ended arrows 64 and 66.

Keys 54 and 56, when extended, can be respectively and lockingly engaged with the body and sleeve portions 38,42 of any of the fluid flow control devices 28,30 and 32, regardless of the direction in which the shifter tool 34 enters the particular flow control device, and the drive system 58 operated to axially shift the device's sleeve 42 in either direction. This permits the shifter tool 34 to be used to shift any selected number of the sleeves 42, in either axial direction, without removing the tool from the well flow conductor.

As but one example, as schematically illustrated in FIG. 1, the shifter tool 34 can be rightwardly moved through the flow control devices 28 and 30 and into the flow control device 32 (as indicated by the dotted line position 34*a* of the tool), and used to leftwardly shift the sleeve 42 of the flow control device 32. The tool can then be leftwardly moved into the flow control device 30 and used to leftwardly shift its sleeve 42.

Turning to FIGS. 4A–4G and 9A–9G, a detailed description of the construction and operation of the shifter tool 34 will now be presented. For purposes of discussion the tool 34 is shown as being inserted within the fluid flow control device 30 and used to leftwardly shift its sleeve 42 from the closed position thereof shown in FIGS. 4E and 4F to the open position thereof shown in FIGS. 9E and 9F. It will be appreciated, however, that the tool 34 may be operated in the same manner with any of the other flow control devices in the system 10.

As previously mentioned, the tubular body 38 of the flow control device 30 is coaxially installed in the production tubing 24. To facilitate this connection the body 38 has reduced diameter, externally threaded end portions 38*a* which are threaded into axially opposed sections of the production tubing. For purposes of illustrative clarity, the production tubing has been removed from the left end portion of the flow control device body 38 shown in FIGS. 4D and 9D.

Adjacent its left end portion 38a the flow control device body 38 has annular groove means in the form of a key profile 54a (FIGS. 4D and 9D) cut into its interior side surface. Profile 54a is configured to lockingly receive the anchor keys 54, and has the indicated ramped and transverse surfaces 68,70 thereon. Each of the other flow control device bodies has an identically configured key profile 54a cut into its interior side surface. Accordingly, the anchor keys 54 can be lockingly engaged with any of the key profiles 54a and thus with its associated flow control device body 38.

A longitudinal side wall portion 38b of the flow control device body 38 (see FIGS. 4E,4F,9E,9F) slidably and coaxially receives the sleeve 42 and is provided at its opposite ends with annular interior ledges 72 and 74 that act to captively retain sleeve 42. To the left of ledge 72 are a plurality of orificed fluid outlet injection ports 76, and a plurality of larger fluid inlet ports 78, formed through the longitudinal side wall portion 38b. When sleeve 42 is in its closed limit position it completely covers the ports 76,78 to preclude fluid flow therethrough. Conversely, when sleeve 42 is leftwardly shifted to its open limit position it completely uncovers the ports 76,78 to permit fluid flow therethrough.

Adjacent its left end the sleeve 42 has annular groove means in the form of a key profile 56a (see FIGS. 4E and 9E) cut into its interior side surface. Profile 56a is configured to lockingly receive the shifter keys 56, and has the indicated ramped and transverse surfaces 80,82 thereon. Each of the other flow control device sleeves has an identically configured key profile 56a cut into its interior side surface. Accordingly, the shifter keys 56 can be lockingly engaged with any of the key profiles 56a, and thus with its associated flow control device sleeve 42.

Still referring to FIGS. 4A-4G and 9A-9G, the key drive section 50 of the shifter tool includes a tubular outer body portion formed by axially opposed lengths 84,86 of metal tubing anchored at their facing ends, by lugs 88, to a hollow cylindrical bulkhead structure 90 (see FIGS. 4B, 4C, 9B and 9C) . Disposed within the tubing length 84, adjacent the right end of the tool section 48, is a motor case 92 (FIGS. 4A and 9A) the right end of which is anchored to the left end of the tubular housing portion 94 of a conventional anti-backlash clutch assembly 96.

Fixedly secured within motor case 92 are the previously mentioned electric translator motor 60 and a gear head 98 operatively connected thereto and having an output shaft 100 operatively connected to the input side of the clutch assembly 96. The right end of the clutch assembly housing 94 is anchored to the left end of a tubular support sleeve 102 (see FIGS. 4A,4B,9A and 9B) coaxially disposed within the tubing section 84. The right end of the sleeve 102 is fixedly secured, by locking lugs 104, to the bulkhead 90, thereby anchoring the electric translator motor 60 in place within the tubing section 84. Support sleeve 102 has a diametrically opposite pair of axially elongated side wall slots 106 formed therein, each slot 106 having left and right end surfaces 108 and 110.

The output shaft 112 of the clutch assembly 96 (FIGS. 4A and 9A) is anchored to the left end of the threaded drive shaft portion 114 of a ball screw assembly 116 disposed within the support sleeve 102 and threadingly received in the traveling nut portion 118 of the ball screw assembly. Nut 118 is threadingly anchored to the left end of an extension tube 120 (FIGS. 4B and 9B) coaxially and slidably received in the support sleeve 102. A diametrically opposite pair of stop block members 122 are externally anchored to the left end of the extension tube 120 and are received in the support sleeve side wall slots 106 for sliding axial movement therealong between their left and right end surfaces 108 and 110.

The right end of the extension tube 120 is anchored, by bolts 124, to the left end of a conventional load cell transducer structure 126 slidingly received within the support sleeve 102. The right end of the load cell 126 is fixedly secured to the left end of a translational drive shaft 128 (see FIGS. 4B,4C,9B and 9C) that extends through the interior of the bulkhead 90 and is anchored at its right end to the left end of a motor case 130 in which the previously mentioned electric rotator motor 62, and a gear head 132 operatively secured thereto, are carried.

For purposes later described, the shifter tool is provided with a potentiometer structure 134 (FIGS. 4B and 9B) that includes a rod portion 136 secured at a left end thereof to the right end of the load cell 126 and slidably received within an electric transducer portion 138 internally carried by the bulkhead 90.

Motor case 130 (FIGS. 4C and 9C) is slidably received in the tubing section 86 for axial movement along its length, but is prevented from rotating relative thereto by means of a diametrically opposed pair of side wall projections 140 formed on motor case 130 and slidably received in corresponding axially extending grooves 142 formed in the interior side surface of the tube section 86. The right end of the motor case 130 is anchored to the left end of the hollow cylindrical housing portion 144 of an anti-backlash clutch assembly 146, with the output shaft 148 of gear head 132 being operatively connected to the input side of the clutch assembly. A side wall slot 150 (FIGS. 4D and 9C) is formed in the open right end portion of the clutch assembly housing 144 and circumferentially extends through an arc of approximately sixty degrees.

The right end of tubing section 86 telescopingly receives a radially inwardly thickened left end portion 152 of a tubular key retainer member 154, and is anchored thereto by lugs 155. A left end portion of an elongated hollow rotational drive shaft 156 (see FIGS. 4D-4F and 9C-9F) slidably and rotatably extends through the key retainer member portion 152 and is anchored at a reduced diameter outer end to the output shaft 158 of the clutch assembly 146. A lug 160 bolted to the left end portion of shaft 156 is received in the clutch assembly housing slot 150 for movement between its circumferentially opposite end surfaces, thereby limiting the available rotational arc of shaft 156 to approximately sixty degrees. From left to right along its length, shaft 156 has diametrically opposed pairs of axially extending exterior side surface grooves 162,164 and 166 formed thereon. The axial lengths of grooves 162 are considerably longer than the lengths of the pairs of grooves 164 and 166.

Figure 4A:
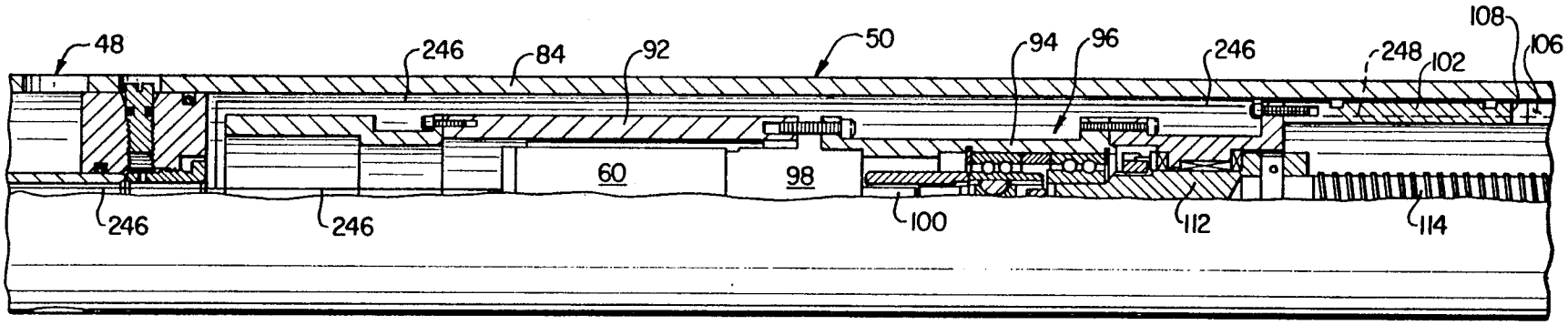
FIGS. 4A-4C are enlarged scale quarter sectional continuations of the shifter tool respectively corresponding to the bracketed tool lengths "FIG. 4A"-"FIG. 4C" in FIGS. 3A and 3B.
Figure 4B:
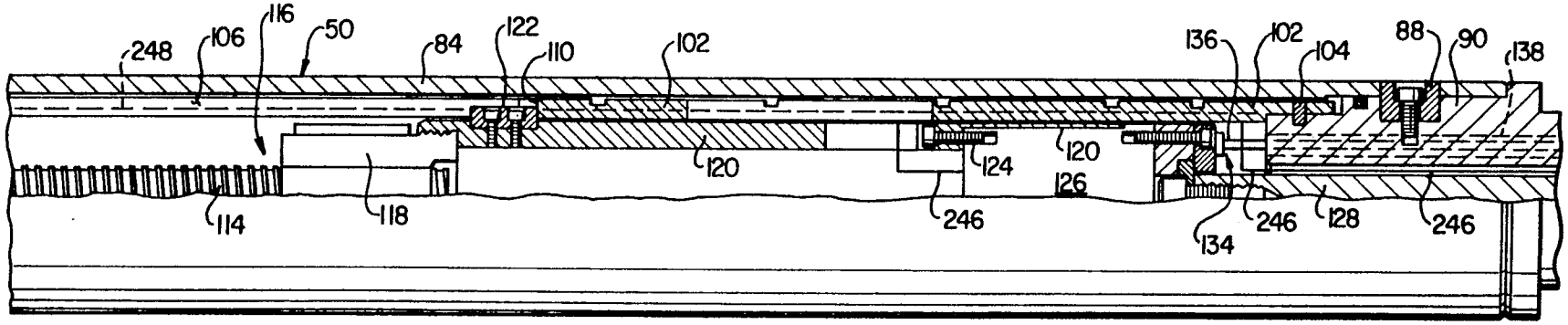
Figure 4C:
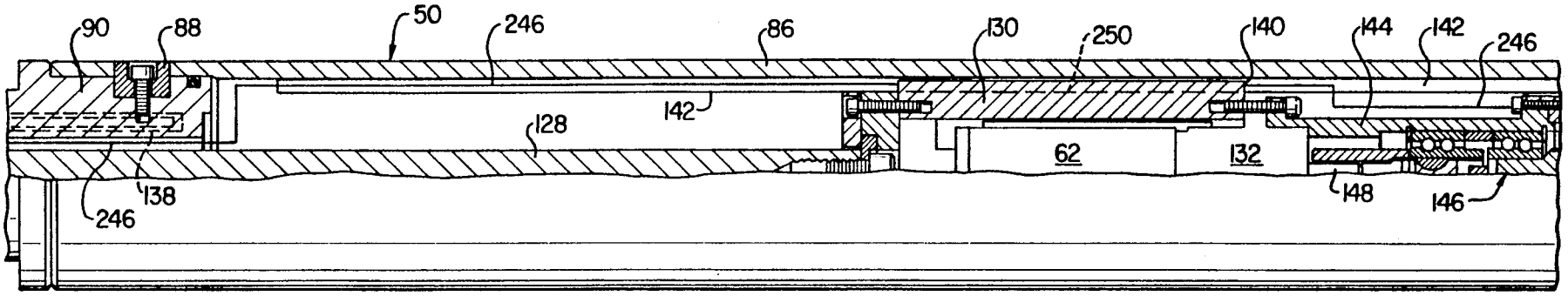
Figure 4D:
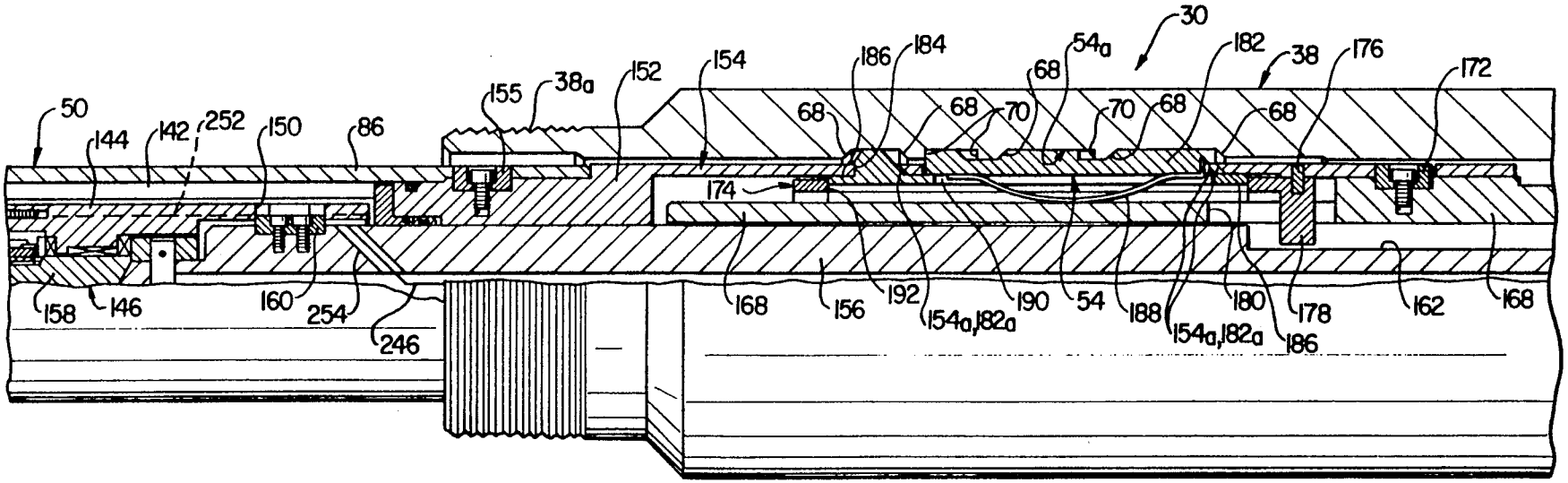
FIGS. 4D-4G are enlarged scale quarter sectional continuations of the shifter tool respectively corresponding to the bracketed tool lengths "FIG. 4D"-"FIG. 4G" in FIGS. 3B and 3C, together with one of the movable sleeve type flow control devices within which the tool is representatively received, with the longitudinal tool portion in FIG. 4G being shown in elevation, and the longitudinal tool portion in FIG. 4F being shown partly in elevation.
Figure 9A:
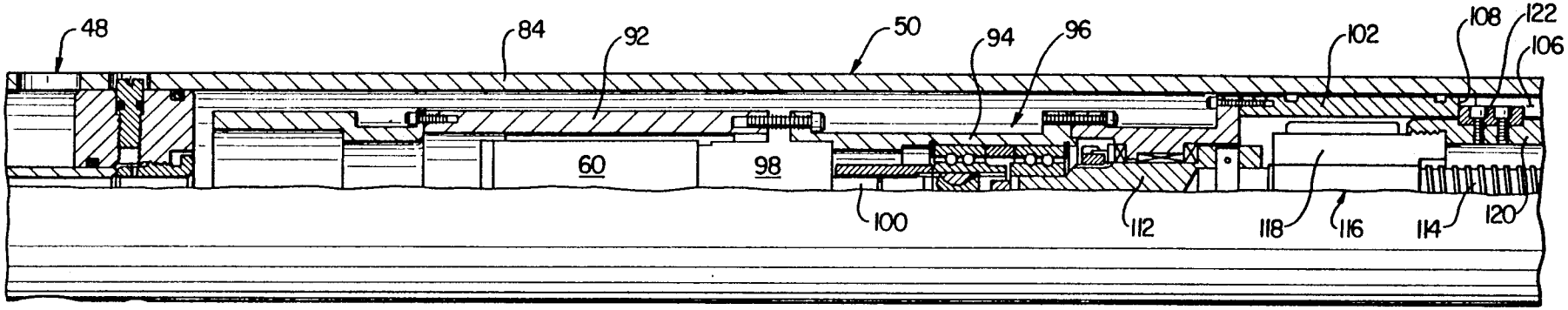
Figure 9B:
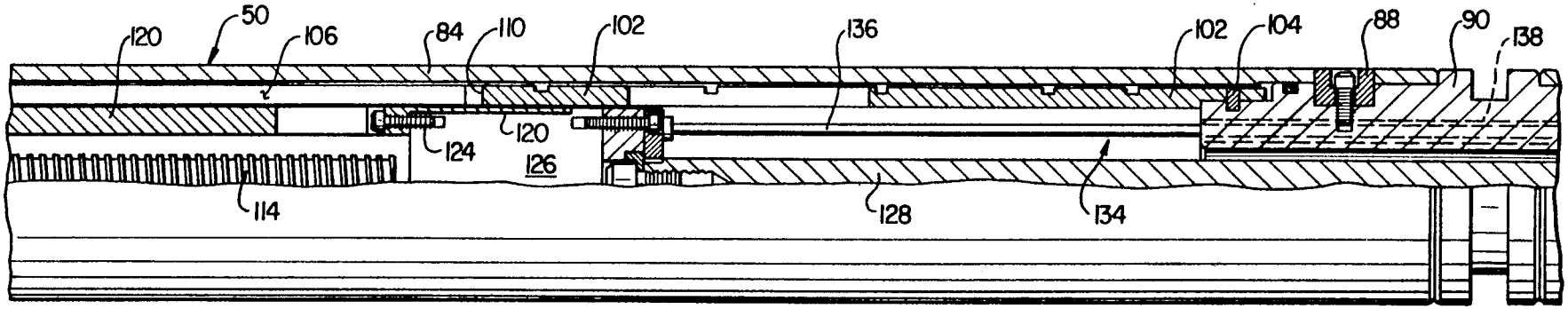
Figure 9C:
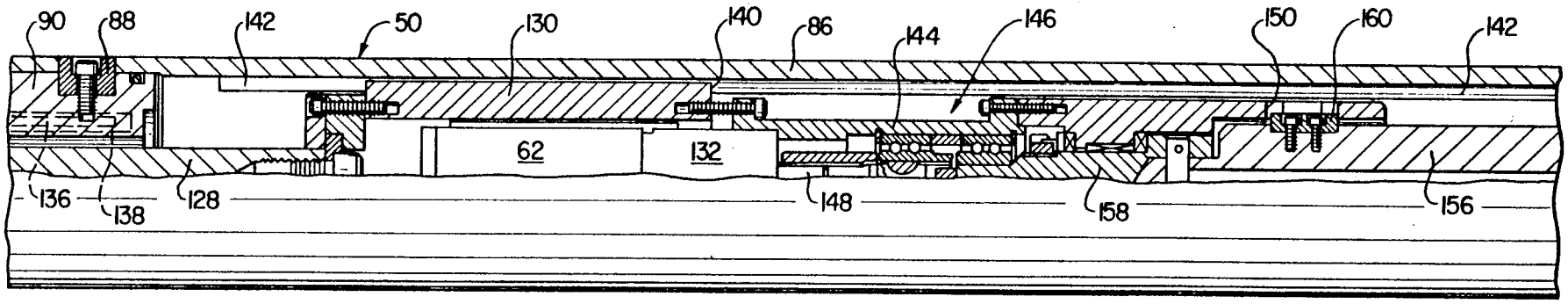
Figure 9D:
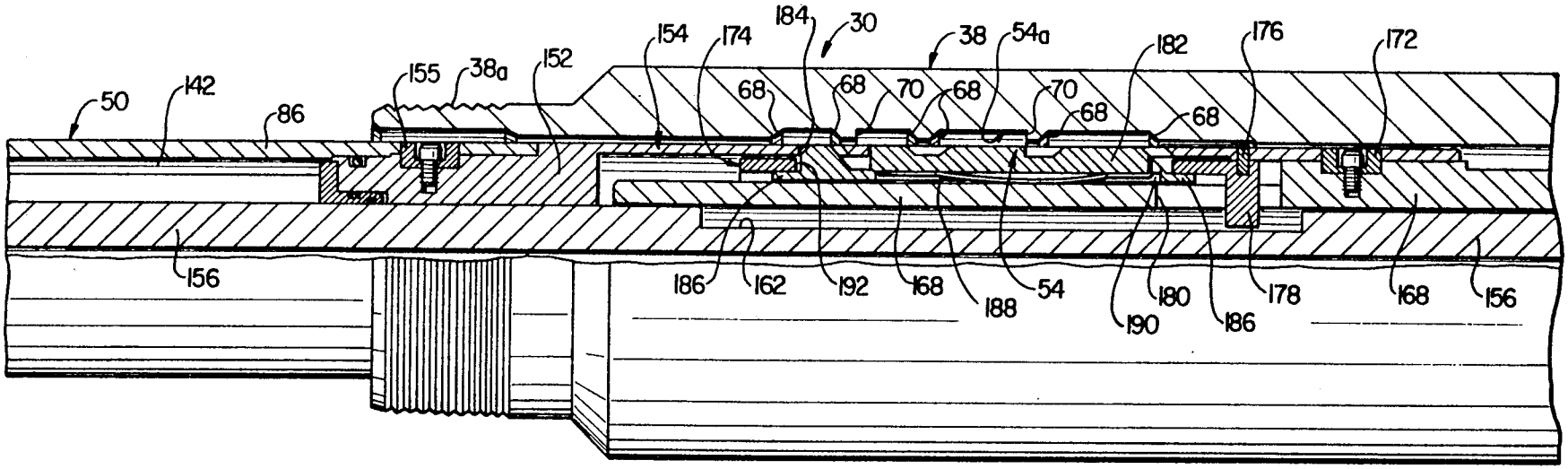

A major longitudinal portion of the rotational drive shaft 156 is telescopingly received within an elongated guide tube 168 having a diametrically opposed pair of axially elongated side wall slots 170 formed therein (FIGS. 4E and 9E), a left end portion of the guide tube 168 (to the left of slots 170) coaxially extending into the open right end of the key retainer member 154 and being anchored thereto by lugs 172 (FIGS. 4D and 9D). Coaxially disposed between the key retainer member 154 and the guide tube 168 is a tubular retraction member 174 that is locked to the interior side of the key retainer member 154 by a diametrically opposed pair of shear pins 176.

A diametrically opposed pair of radially inwardly extending lugs 178 on the right end of the retraction member 174 extend through corresponding arcuate circumferential slots 180 in the guide tube 168 and into the axially elongated grooves 162 in the rotational drive shaft 156. Slots 180 are circumferentially sized to permit the retraction member 174 to be rotated through an arc of approximately sixty degrees relative to the key retainer member 154 in response to driven rotation of the drive shaft 128 by the motor 62.

The diametrically opposite anchor keys 54 have body portions 182 that are received in corresponding side wall slots 184 in the key retainer member 154, with radially thinned opposite end portions 186 of each anchor key 54 underlying the interior side surface of the key retainer member 154 to captively retain the end portions 186 within the key retainer member. Anchor keys 54 are radially outwardly biased toward their extended positions shown in FIG. 4D by bow spring members 188 having their opposite ends received in an inner side surface notches 190 formed in the anchor keys, and longitudinally intermediate portions bearing on the exterior side surface of the guide tube 168.

As previously mentioned, the anchor keys 54 have exterior side surface profiles, with the indicated ramped and transverse surface portions therein, that permit the anchor keys (when in their extended or "seeking" positions) to be radially outwardly and lockingly received in the profile 54*a* cut into the interior side surface of body portion 38 of any of the flow control devices. However, the anchor keys 54 are not similarly receivable in any of the profiles 56*a* cut into the interior side surfaces of the sleeve portions 42 of the flow control devices.

With the anchor keys 54 in their extended positions they may be moved with the shifter tool into either end of the flow control device body 38 until they automatically snap outwardly into locking engagement with the body profile 54*a*, the various groove surfaces in the profile 54*a* simply camming the keys 54 inwardly until they are brought into axial alignment with the profile 54*a* to permit this snap-out locking interengagement. If the anchor keys 54 are brought leftwardly into the flow control device body 38 the shifter key profile 56*a* simply cams the anchor keys inwardly, against the resilient biasing force of springs 188, as they pass the profile 56*a* on the way to their complementarily configured profile 54*a*.

As illustrated in FIG. 4D, when the anchor keys 54 are in their extended positions, their opposite end portions 186 are received in a diametrically opposed pair of axially elongated side wall slots 192 formed in the tubular retraction member 174. However, in a manner subsequently described, when the retraction member 174 is rotationally driven away from its FIG. 4D position by the rotational drive shaft 156, the retraction member 174 operates to radially inwardly drive the anchor keys 54 to their retracted positions shown in FIG. 9D, thereby withdrawing the anchor keys 54 from the body profile 54*a* and uncoupling the shifter tool 34 from the flow control device body 38.

Referring now to FIGS. 4E-4G and 9E-9G, a tubular right body end portion 194 of the shifter tool key drive section 50 (see FIGS. 4G and 9G) coaxially circumscribes a right end portion of the rotational drive shaft 156. The left end of body portion 194 coaxially circumscribes and is threadingly anchored to the right end of the guide tube 168. A reduced diameter right end 196 of the body portion 194 is threaded into the left end of the logging tool 52 and has a central bore 198 extending to a conventional wire connector structure 200 within the interior of the logging tool 52.

Figure 8:
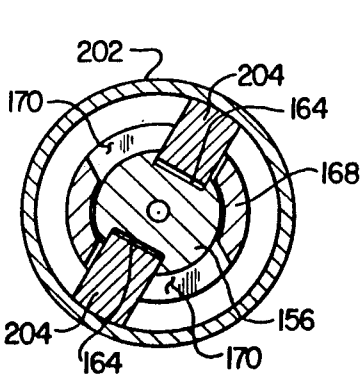
FIG. 8 is a cross-sectional view through the tool taken along line 8—8 of FIG. 4E.

A tubular key retainer member 202 (see FIGS. 4E and 9E) is spaced rightwardly apart from the previously described key retainer member 154 and coaxially and outwardly circumscribes the rotational drive shaft 156. Radially outer end portions of a diametrically opposed pair of connector blocks 204 (see FIG. 8 also) are captively retained on the interior side of a left end portion of the key retainer member 202 by a pair of snap rings 206 secured to key retainer member 202 on opposite sides of the blocks 204. Snap rings 206 prevent the blocks 204 from axially moving relative to the key retainer member 202, but permit curved outer end surfaces of the blocks to slidingly rotate along the interior side surface of the key retainer member 202. Inner end portions of the blocks 204 extend inwardly through the guide tube slots 170 and are received in the side wall grooves 164 of the rotational drive shaft 156 to translationally and rotationally lock the blocks 204 to the shaft 156, and translationally lock the key retainer member 202 to shaft 156.

Figure 6:
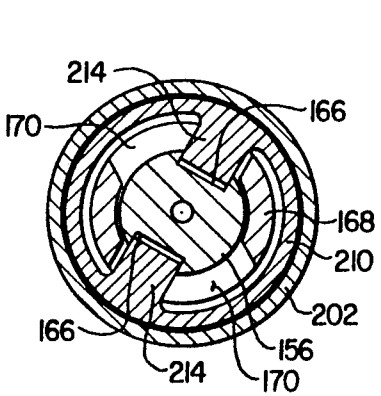
FIG. 6 is a cross-sectional view through the tool taken along line 6—6 of FIG. 4E.
Figure 5:
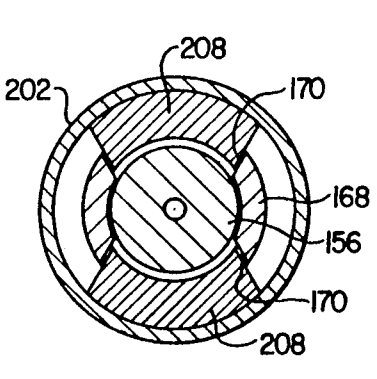
FIG. 5 is a cross-sectional view through the tool taken along line 5—5 of FIG. 4E.
Figure 9G:
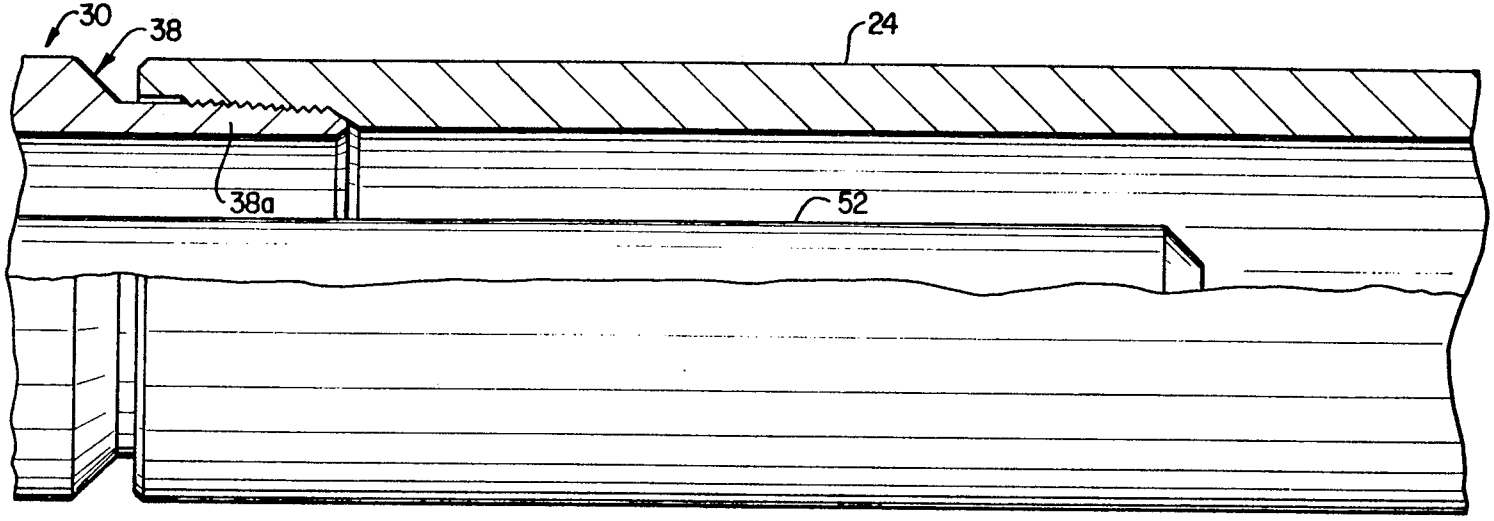
FIG. 9A-9G are quarter sectional continuation views of the tool respectively similar to those shown in FIGS. 4A-4G, but with certain internal components of the tool and the flow control device having been operatively shifted.
Figure 8A:
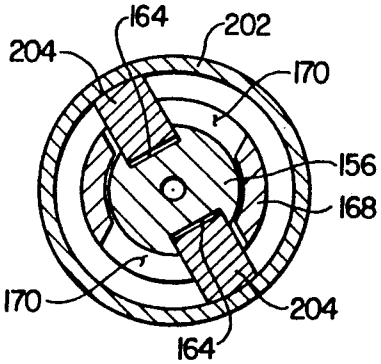

Immediately to the right of the connector blocks 204 are a diametrically opposed pair of arcuate rotational stop members 208 (see FIG. 5 also) that are bolted to the inner side of the key retainer member 202. Inner side portions of the arcuate stop members 208 are slidably received in the elongated guide tube slots 170 in a manner rotationally locking the key retainer member 202 to the guide tube guide tube 168. Immediately to the right of the stop members 208 is a tubular retraction member 210 (see FIG. 6 also) that is coaxially disposed between the key retainer member 202 and the guide tube 168.

A left end of the retraction member 210 is locked to the interior side of the key retainer member 202 by a diametrically opposed pair of shear pins 212. A diametrically opposed pair of lugs 214 extend radially inwardly from the left end of the retraction member 210 and extend through the guide tube slot 170 into the opposite side wall grooves 166 of the rotational drive shaft 156 in a manner translationally and rotationally locking the retraction member 210 to the shaft 156.

The shifter keys 56 (see FIGS. 4A,9A and 7) have body portions 216 received in side wall slots 218 formed in the key retainer member 202, and opposite end portions 220 that underlie the slots 218 and extend past their opposite ends. Bow springs 222 are installed between the shifter keys 56 and the guide tube 168 and resiliently bias the shifter keys 56 outwardly toward their extended positions shown in FIG. 4E. With the shifter keys 56 in their extended positions, and the related components of the shifter tool in their positions cross-sectionally depicted in FIGS. 5-8, the opposite ends 220 of each of the shifter keys 56 are received in one of a diametrically opposed pair of elongated side wall slots 224 formed in the tubular retraction member 210.

As previously mentioned, the shifter keys 56 have exterior side surface profiles, with the indicated ramped and transverse surface portions therein, that permit the shifter keys (when in their extended or "seeking" positions) to be radially outwardly and lockingly received in the profiles 56*a* cut into the interior side surface of sleeve portion 42 of any of the flow control devices. However, the shifter keys 56 are not similarly receivable in any of the profiles 54a cut into the interior side surfaces of the body portions 38 of the flow control devices.

With the shifter keys 56 in their extended positions they may be moved with the shifter tool into either end of the flow control device body 38 until they automatically snap outwardly into locking engagement with the sleeve profile 56a, the various groove surfaces in the profile 56a simply camming the keys 56 inwardly until they are brought into axial alignment with the profile 56a to permit this snap-out locking interengagement. If the shifter keys 56 are brought rightwardly into the flow control device body 38 the anchor key profile 54a simply cams the shifter keys inwardly, against the resilient biasing force of their associated springs 222, as they pass the profile 54a on the way to their complementarily configured profile 56a.

Figure 7:
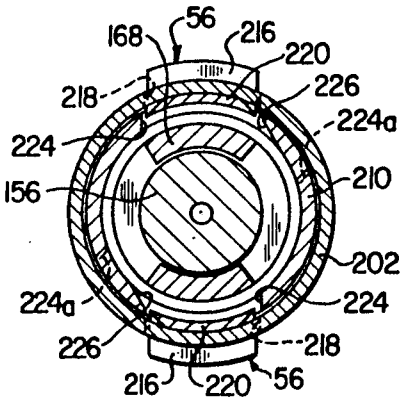
FIG. 7 is a cross-sectional view through the tool taken along line 7—7 of FIG. 4E.

As best illustrated in FIG. 7, tapered side edge portions 226 of the tubular retraction member 210 axially extend along sides of the retraction member side wall slots 224. Additionally, circumferentially enlarged portions 224a of the slots 224 are extended through these tapered edge portions. The enlarged slot portions 224a have axial widths slightly larger than the body portions 216 of the shifter keys 56 positioned between the key end portions 220 and are axially aligned with such body portions. The previously described side wall slots 186 in the tubular anchor key retraction member 174, and side wall edge portions of the retraction member 174 extending axially along its slots 186, are similarly configured and related to the anchor keys 54.

The two tubular retraction members 174 and 210 respectively associated with the anchor and shifter keys 54 and 56 are, as previously described, rotationally locked to the rotational drive shaft 156 for conjoint driven rotation thereby between a first position (see FIGS. 4D,4E and 7) in which the anchor and shifter keys 54,56 are in their extended positions, and a second position (see FIGS. 9D,9E and 7A) in which the retraction members 174,210 have been rotated through a counterclockwise arc of approximately sixty degrees by the drive shaft 156 in response to operation of the rotator motor 62.

Figure 7A:
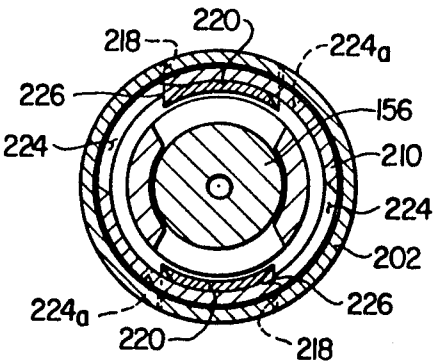
Figure 6A:
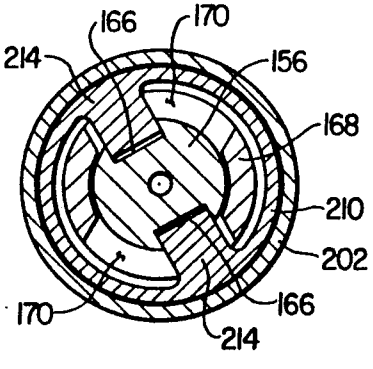

By comparing FIGS. 7 and 7A it can be seen that this counterclockwise driven rotation of the shifter key retraction member 210 causes its tapered leading edge portions 226 to inwardly engage the shifter key body end portions 220 and radially inwardly cam the shifter keys 56 to their retracted positions shown in FIG. 7A against the resilient biasing force of the bow springs 222. During this driven counterclockwise rotation of the retraction member 210, the body portions 216 of the shifter keys 56 circumferentially enter the extended portions 224a of the retraction member side wall slots 224. The simultaneously rotated retraction member 174 operates in the same manner to inwardly cam the anchor keys 54 to their retracted positions. Subsequent driven rotation of the retraction member 210 back to its initial FIG. 7 position permits the bow springs 222 to return the shifter keys 56 to their extended positions as the simultaneously rotated retraction member 174 permits the bow springs 188 to return the anchor keys 54 to their extended positions.

As can also be seen by comparing FIGS. 4A–4G to FIGS. 9A–9G, the translator motor 60 may be operated to axially drive the rotator motor 62 toward or away from the translator motor via the action of the ball screw assembly 116. This provides the shifter tool with the ability to selectively drive the shifter keys 56 axially toward or away from the axially stationary anchor keys 54, this axial key shifting capability of the tool being independent of its ability to forcibly retract the outwardly biased anchor and shifter keys via operation of the rotator motor 62 and the retraction members 174 and 210 operatively linked thereto as described above.

Figure 4E:
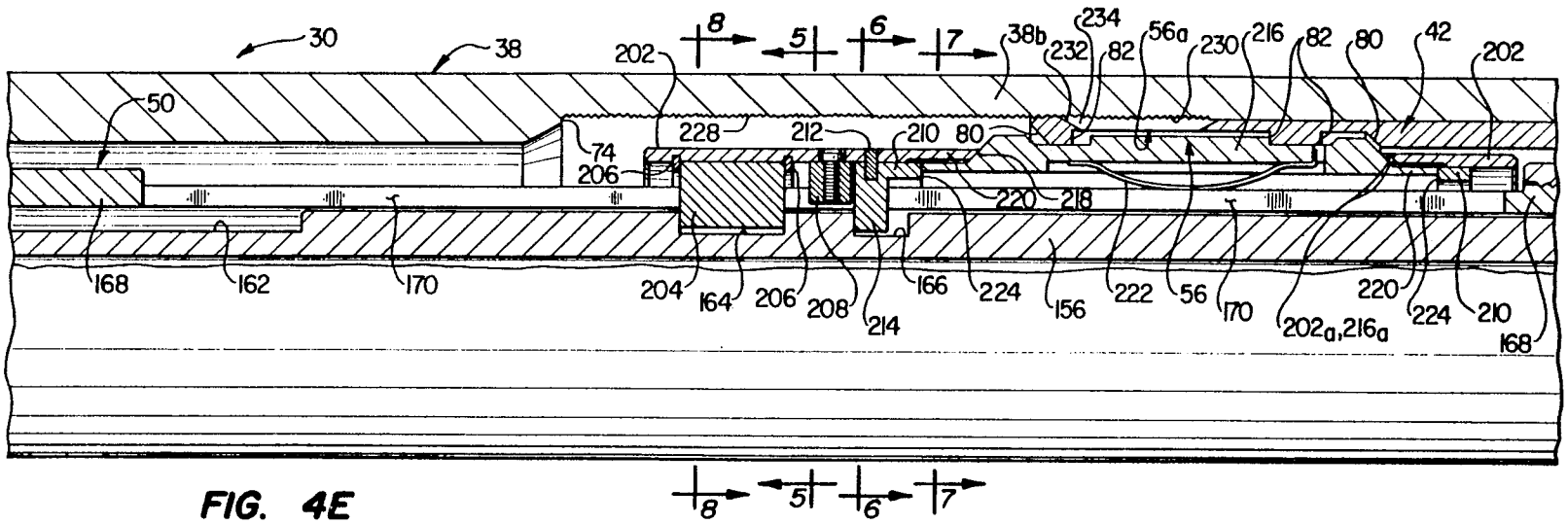
Figure 4F:
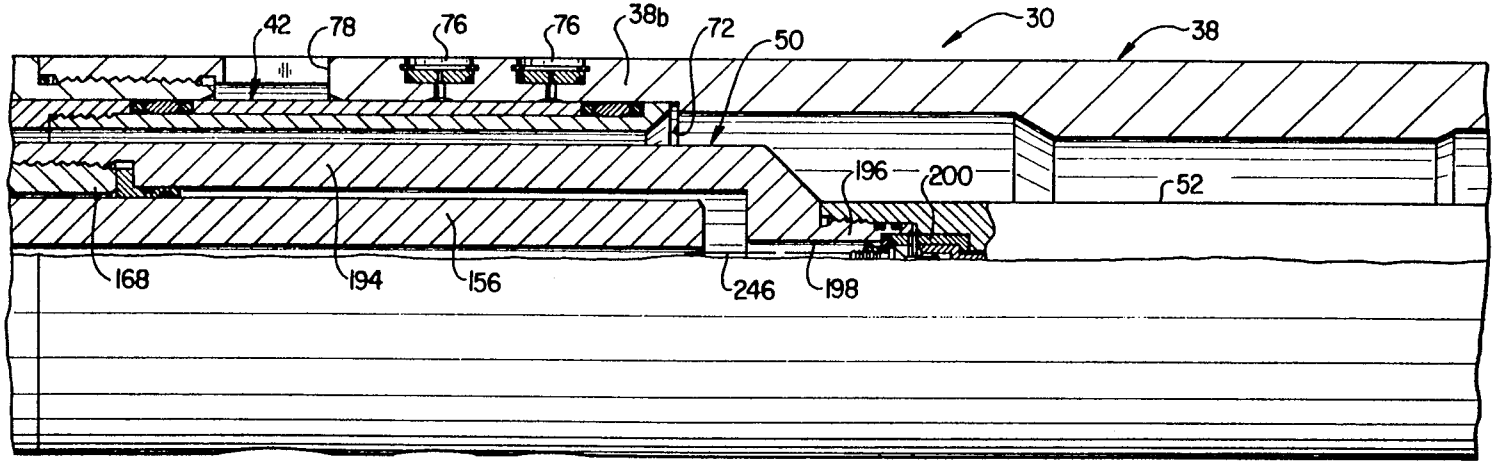
Figure 4G:
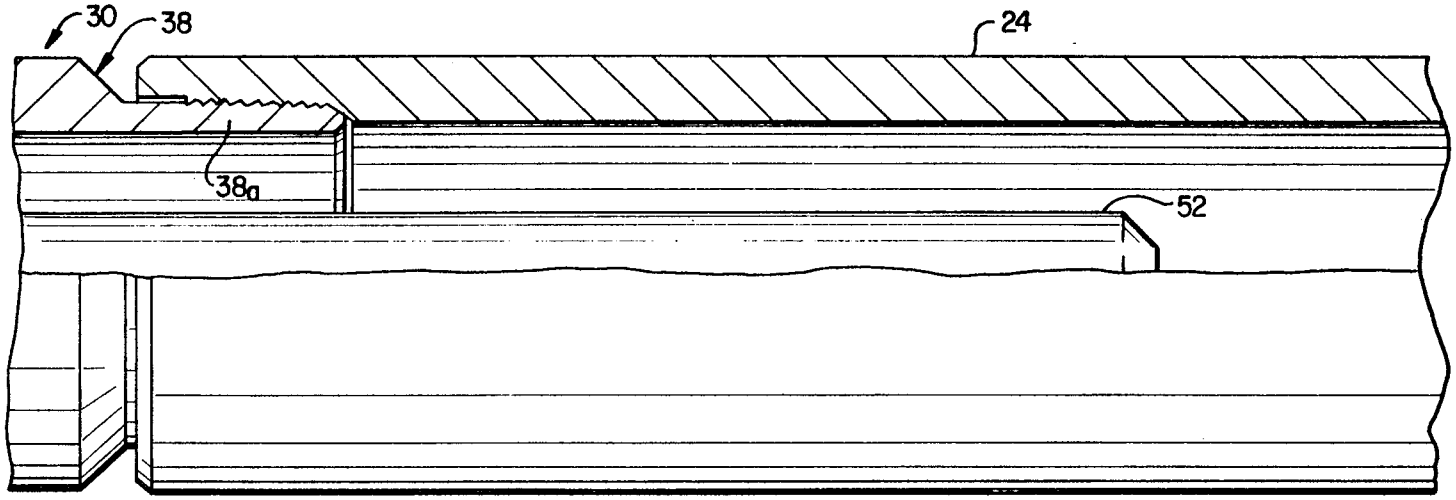
Figure 9E:
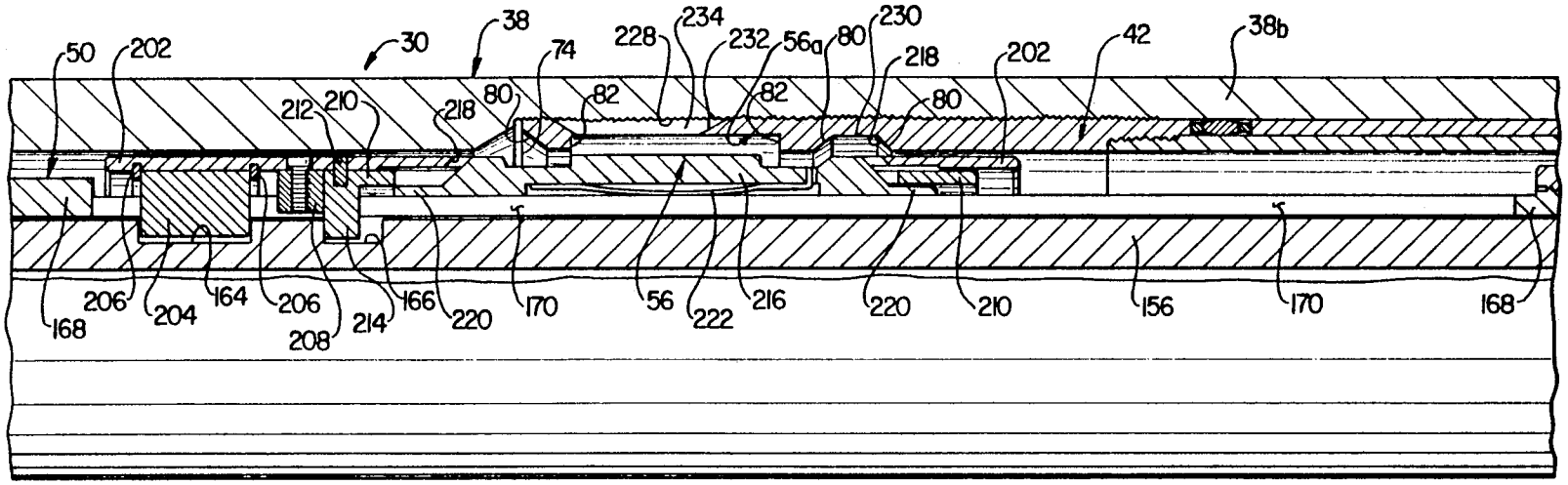
Figure 9F:
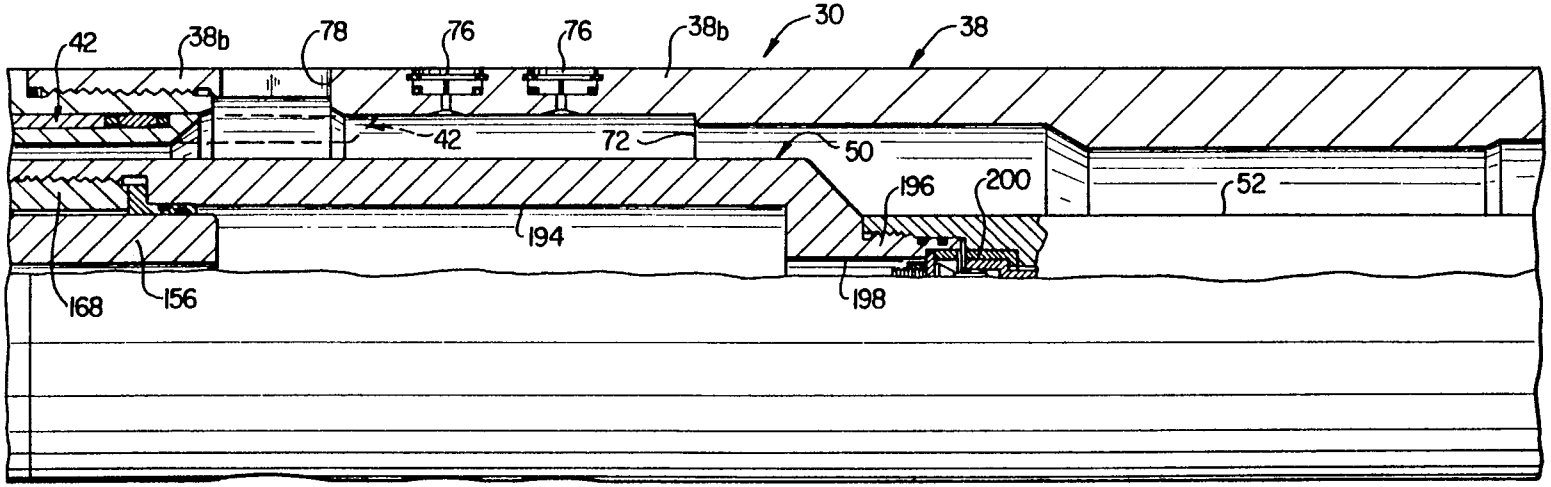

To representatively illustrate the operation of the shifter tool 34 in the flow control system 10, it will be assumed for purposes of discussion that a need exists to shift the sleeve 42 of the flow control device 30 from its fully closed position shown in FIGS. 4E and 4F to its fully opened position, shown in FIGS. 9E and 9F, in which the sleeve 42 uncovers both the orificed outlet injection ports 76 and the fluid inlet ports 78 in the body 38 of the flow control device 30. It will further be assumed that the shifter tool 34 is initially out of the production tubing 24, and that to reach the target flow control device 30 the tool must be first moved through a series of other flow control devices (including device 28 shown in FIG. 1).

With its anchor and shifter keys 54,56 retracted and in their relative axial positions shown in FIGS. 4D and 4E, the shifter tool 34 is lowered into the production tubing 24 on the coil tubing 36 and passed through all of the flow control devices that upwardly precede the target device 30. As the tool exits the flow control device 28 on its way to the target device 30, the rotator motor 62 is operated to free the keys 54,56 from their retracted positions and permit their springs 188,222 to drive them out to their extended or seeking positions. As the keys 54,56 enter and pass through the body 38 of the flow control device 30, they are inwardly cammed by the interior body and sleeve key profiles 54a and 56a, as previously described, until the keys 54,56 are respectively aligned with the profiles 54a,56a at which point the springs 188,210 drive the keys 54,56 outwardly into locking engagement with their associated profiles 54a,56a.

With the tool locked to the body 38 by the anchor keys 54, the translator motor 60 is then operated to forcibly drive the shifter keys 56 toward the anchor keys 54 to thereby axially shift the sleeve 42 to its fully open left limit position shown in FIGS. 9E and 9F. Importantly, since the tool is locked to the flow control device body 38 by the anchor keys 54 during this axial shifting operation, the shifting forces are borne by the tool and not by the coil tubing 36. Stated in another manner, once the tool is operatively engaged with the flow control device the coil tubing does not have to be pushed or pulled to open or close the flow control sleeve.

While the axial shifting of the sleeve 42 is taking place, the load cell 126 and the potentiometer 134 (via subsequently described wiring means extended through the tool body) continuously transmit to the surface electrical signals respectively indicative of the shifting force being applied to the keys 56, and the axial position of the keys 56 relative to the keys 54. This conveniently permits the operator of the tool to monitor the downhole operation thereof. For example, when the sleeve bottoms out at either of its axial limit positions while being axially driven by the translator motor 60, the magnitude of the load cell output signal sharply increases to alert the operator that the sleeve has been fully opened or closed as the case may be.

To facilitate a reliable retention of the sleeve 42 in its partially shifted position after the tool has been disengaged and removed from its associated flow control device, axially extending series of schematically depicted V-threads 228,230 are respectively formed in the interior side surface of the flow control device body 38 and a left end portion of the sleeve 42 as illustrated in FIGS. 4E and 9E. Thread series 228,230 are interengaged with one another and cause the sleeve 42 to "ratchet" along the interior side surface of the body 38 as the sleeve is axially moved relative thereto, the interengaged thread series 228,230 functioning to forcibly but releasably hold the partially shifted sleeve 42 in place within the body 38 until the tool 34 is subsequently used to move the sleeve 42.

The ratchet-like movement of the sleeve 42 along the interior side surface of the flow control device body 38 during shifting use of the tool 34 on the sleeve is facilitated by a circumferentially spaced series of double-ended collet openings 232 formed transversely through the left end of the sleeve to define thereon a circumferentially spaced series of relatively thin ribs 234 interdigitated with the collet openings. This radially weakens the left end of the sleeve in a manner permitting it to inwardly flex as it ratchets along the threads 228.

A breakaway safety release mechanism is incorporated in the shifter tool 34 and is operative to permit the tool to be pulled axially outwardly from the flow control device 30 when the anchor and shifter keys 54,56 are lockingly engaged therewith, as shown in After the sleeve 42 has been opened, the rotator motor 62 is operated to retract the keys 54 and 56, thereby disengaging the tool from the now adjusted flow control device 30. The shifter tool may then be withdrawn from the adjusted flow control device 30, in either direction, and moved to one or more of the other flow control devices, to either open or close their sleeves, without removing the tool from the production tubing.

Thus, in accordance with a primary advantage provided by the present invention, the tool 34 may be used to shift any or all of the flow control device sleeves, in either axial direction, in a single trip down into the production tubing (or other type of well flow conductor as the case may be).

Also, as will be appreciated, due to the unique key retraction capability provided by the electromechanical drive system disposed within the tool body, the sleeve 42 need not be shifted from its closed position clear to its fully opened position. Instead, the sleeve 42 can, if desired, be shifted to an axially intermediate, dotted line position thereof (see FIG. 9F) in which only the orificed fluid outlet injection ports 76 are uncovered. After this partial shifting of the sleeve 42, the keys 54,56 can be retracted as described above and the tool sent on its way to fully or partially shift another flow control sleeve. This partial shifting capability of the tool permits the unique incorporation of the orificed outlet injection ports 76 into the flow control device 30 in addition to the usual fluid inlet ports 78. FIGS. 4D and 4E, and the tubular retraction members 174,,210 for some reason cannot be rotated to retract the anchor and shifter keys from their extended positions shown in FIGS. 4D and 4E to their retracted positions shown in FIGS. 9D and 9E.

The release mechanism comprises the shear pins 176,212 (see FIGS. 4D and 4E) that respectively lock the tubular retraction members 174,210 to the key retainer members 154 and 202, cooperatively engageable facing ramped surfaces **154*a*,182*a* respectively formed on the key retainer member 154 and the anchor key body portions 182 (see FIG. 4A), and cooperatively engageable facing ramped surfaces 202*a*,216*a* respectively formed on the key retainer member 202 and the shifter key body portions 216 (see FIG. 4D**).

When the shifter tool 34 is pulled upwardly (i.e., leftwardly as viewed in FIGS. 4D and 4E) with the anchor and shifter keys interiorly locked to the body and sleeve portions of the flow control device 30, the shear pins 176,212 break. This shear pin breakage permits the upward pull on the shifter tool 34 to correspondingly cause the key retainer members 154,202 to be forcibly moved leftwardly relative to their associated anchor and shifter key body portions 182,216. In turn, this drives the ramped key retainer surfaces **154*a*,202*a* into their facing ramped key body surfaces 182*a*,216*a* to thereby cause the key retainer members to inwardly cam the anchor and shifter keys from their extended positions shown in FIGS. 4D and 4E to their retracted positions shown in FIGS. 9D and 9E**.

The unique sleeve shifting and retraction capabilities built into the tool 34 permit it to be used in several additional novel manners that conventionally designed shifter tools are typically incapable of. For example, with reference now to the highly schematic drawing FIGS. 10A–10C, the tool 34 may be used in conjunction with the logging tool 52 (or another type of inspection device such as a video camera attached to the lower end of the tool section 50) to inspect fracture zone well fluid at a movable sleeve type flow control device 238 installed in -a representatively vertical section of the production tubing 24.

Figure 10A:
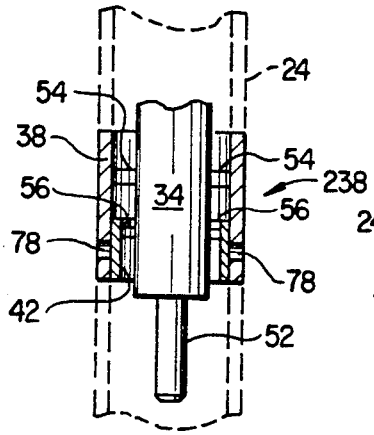
FIGS. 10A-10C are highly schematic cross-sectional views through a movable sleeve type fluid flow control device and sequentially illustrate a method of using the shifter tool in conjunction with an inspection device, such as a logging tool or a video camera, to inspect well fluid adjacent the flow control device.
Figure 10B:
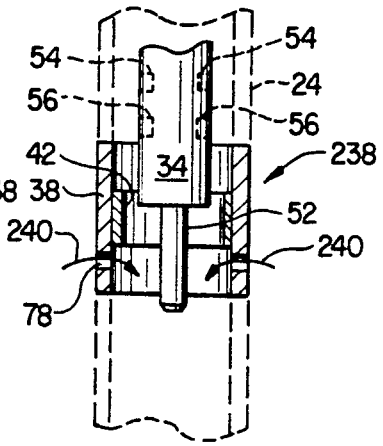
Figure 10C:
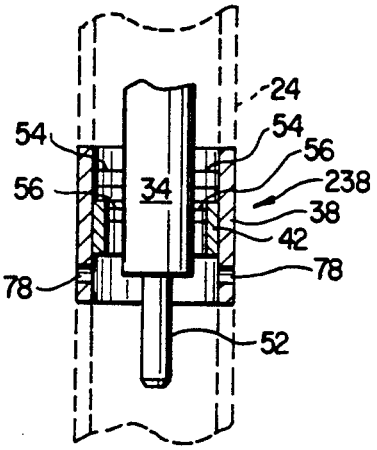

To perform this method, the tool 34 is lowered through the production tubing 24 into the flow control device 238 and operatively locked to its body 38 and downwardly closed sleeve 42 as shown in FIG. 10A. The tool 34 is then used to upwardly open the sleeve 42, disengaged from the device 238, and raised within the production tubing 24 (FIG. 10B) to position the logging tool 52 adjacent the opened fluid inlet ports 78 through which fracture zone fluid 240 is now inwardly flowing. After the fluid inspection process is completed, the tool 34 is again lowered into the flow control device 238 (see FIG. 10C), operatively locked to its body 38 and the opened sleeve 42, and used to return the sleeve 42 to its originally closed position shown in FIG. 10A.

Importantly, since the tool 34 does not have to be removed from the production tubing 24 after opening the sleeve 42, and then reinserted into the production tubing to re-close the sleeve, the temporarily raised tool 34 (FIG. 10B), whose outer diameter has been substantially reduced relative to the inner diameter of the production tubing for illustrative clarity, operates to substantially block the interior of the production tubing above the inlet ports 78 to inhibit upward flow of the incoming fluid 240 through the production tubing 24.

Figure 11A:
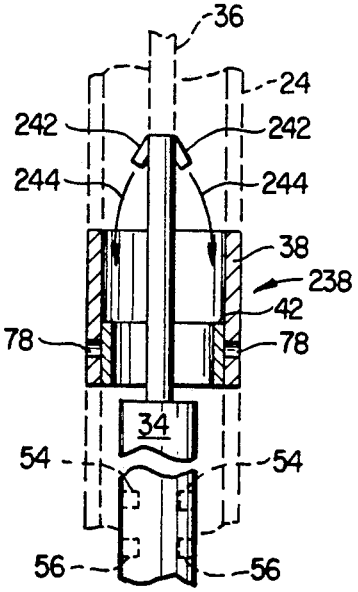
FIGS. 11A–11C are highly schematic cross-sectional views through a movable sleeve type fluid flow control device and sequentially illustrate a method of using the shifter tool to backwash the interior of and then open the flow control device.
Figure 11B:
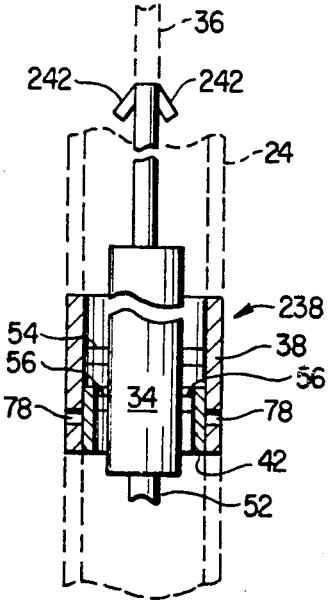
Figure 11C:
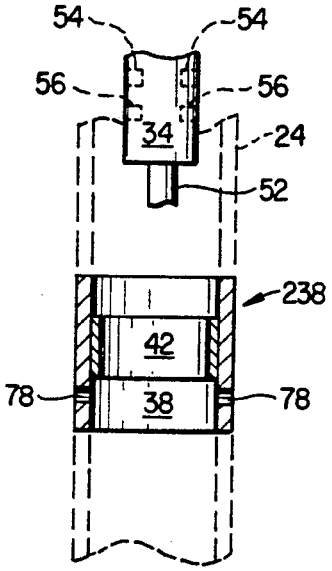

Referring now to the highly schematic drawing FIGS. 11A–11C, the tool 34 may also advantageously used to backwash the interior of the representative flow control device 238 before being used to open its closed sleeve 42, thereby cleaning out the key profiles in the flow control device before lockingly engaging the anchor and shifter keys 54,56 with them. To effect this backwashing operation, conventional back pressure valves 242 are installed on the top end of the tool and are operative to downwardly discharge a suitable pressurized fluid 244 flowed into the interior of the top end portion of the tool via the coil tubing 36.

As illustrated in FIG. 11A, with the sleeve 42 in its closed position, the enlarged diameter portion of the tool is lowered through the interior of the flow control device 238 to a position placing the back pressure valves 242 above the device 238 and the enlarged diameter portion of the tool below the device 238. The pressurized fluid 244 is then forced outwardly and downwardly through the valves 242 to backwash the interior of the device 238. The enlarged diameter portion of the tool serves to block off the production tubing 24 below the device 238, thereby causing the discharged fluid 244 to backwash mud, sand and the like from the interior of the device 238 and upwardly through the production tubing 24.

After the backwashing of the interior of the flow control device 238 is completed, the tool 34 is raised into the device, as shown in FIG. 11B, lockingly engaged with the device body 38 and the closed sleeve 42, and used to upwardly open the sleeve 42. The tool 34 is then disengaged from the device 238 and lifted outwardly therefrom as shown in FIG. 11C.

To supply the necessary electrical power to the motors 60 and 62, the load cell 126, the potentiometer 134, and the logging tool 52 or other inspection device (if used), appropriate power and control wiring is extended axially through the interior of the tool 34 between its upper and lower ends and suitably connected to these electrical components. To illustrate the general routing of this wiring, with reference to FIGS. 4A–4G, the wiring has been illustrated in highly schematic single line form and will be hereinafter referred to simply as wiring means 246.

Wiring means 246 is extended through the interior of the coil tubing 36 and passed in a conventional manner through the upper sections 44,46 and 48 of the tool 34. Upon its exit from the tool section 48 (FIG. 4A), wiring means 246 is sequentially extended through an external side surface groove 248 in the tubular support sleeve 102 (FIGS. 4A and 4B); through the interior of the bulkhead structure 90 (FIGS. 4B and 4C); through an external side surface groove 250 in the motor case 130 (FIG. 4C); through an external side surface groove 252 in the clutch assembly housing 144 (FIG. 4D) ; into the interior of shaft 156 through an inclined access bore 254 (FIG. 4D) formed in the shaft; axially through the interior of shaft 156 and outwardly through its right end (FIG. 4F); and axially through the interior of the logging tool 52.

The foregoing detailed description is to be clearly understood as being given by way of illustration and example only, the spirit and scope of the present invention being limited solely by the appended claims.

What is claimed is:

1. A shifter tool operative to axially shift an internally grooved sleeve of a movable sleeve type flow control device installed in a subsurface well flow conductor, said shifter tool comprising:

a hollow body extending along an axis and being axially movable through the well flow conductor into and through the sleeve;

key means carried by said body and configured to be lockingly engaged with the internal groove portion of the sleeve, said key means being movable relative to said body, in directions transverse to its axis, between a first position in which said key means project outwardly beyond said body and a second position in which said key means are inwardly retracted from said first position; and drive means carried within said body and being operable to selectively and independently drive said key means:

(1) between said first and second positions thereof, and (2) relative to a portion of said body in a direction parallel to said axis of said body.

2. The shifter tool of claim I wherein:

said key means in said second position thereof are retracted into said body.

3. The shifter tool of claim 1 wherein said drive means carried within said body include:

spring means for resiliently biasing said key means toward said first position thereof, a retraction member operatively drivable to engage said key means and forcibly move said key means from said first position thereof to said second position thereof, and electric motor means coupled to said retraction member for operatively driving it.

4. The shifter tool of claim 3 wherein:

said retraction member has a generally tubular configuration, extends along a longitudinal axis, and has side wall opening means through which said key means extend, and said electric motor means are operative to selectively rotate said retraction member, about said longitudinal axis thereof, relative to said body.

5. The shifter tool of claim 4 wherein:

said electric motor means include a first electric motor anchored within said body, and a second electric motor carried within said body for axial movement relative thereto, and said drive means carried within said body further include:

means interconnected between said first and second electric motors for axially driving said second electric motor selectively toward and away from said first electric motor in response to operation of said first electric motor, and means for coupling said key means and said retraction member to said second electric motor for driven axial movement therewith relative to said first electric motor.

6. The shifter tool of claim 5 wherein:

said retraction -member is axially locked to a key retainer portion of said shifter tool by frangible means operative to be broken, in response to an upward pull of said shifter tool while said key means are lockingly engaged with the internal groove portion of the sleeve, to permit said key retainer portion to be forcibly moved axially relative to the lockingly engaged key means by the upward pulling of said shifter tool, and said shifter tool further comprises cooperatively interengageable ramped surface means formed on said key retainer portion and said key means and operable, in response to forcible axial movement of said key retainer portion relative to said key means, to cause said key retainer portion to cam said key means inwardly from said first position thereof to said second position thereof.

7. A shifter tool operable to engage and axially shift a sleeve member coaxially and slidably retained within the hollow body portion of a movable sleeve type flow control device installed in a subsurface well flow conductor, said shifter tool comprising:

a generally tubular body axially insertable into the well flow conductor and longitudinally movable therethrough into the flow control device, said shifter tool body having first and second axially spaced side wall opening means therein;

first key means releasably lockable with the flow control device body portion in a manner releasably locking said shifter tool body thereto, said first key means being received in said first side wall opening means for radial movement relative to said shifter tool body between an extended position in which said first key means radially project outwardly beyond said shifter tool body, and a retracted position in which said first key means are radially retracted into said first opening means;

second key means releasably lockable with the flow control device sleeve member, said second key means being received in said second side wall opening means for radial movement relative to said shifter tool body between an extended position in which said second key means radially project outwardly beyond said shifter tool body, and a retracted position in which said second key means are radially retracted into said second opening means, said second key means further being supported on said shifter tool body for driven axial movement toward and away said first key means;

first drive means, disposed within said shifter tool body, for resiliently biasing said first and second key means toward said extended positions thereof; and second drive means disposed within said shifter tool body and selectively operable to:

(1) radially drive said first and second key means from their extended positions to their retracted positions, and (2) axially drive said second key means toward and away from said first key means.

8. The shifter tool of claim 7 wherein said first drive means include:

first spring means interposed between and operatively engaging said first key means and a first interior portion of said shifter tool, and second spring means interposed between and operatively engaging said second key means and a second interior portion of said shifter tool.

9. The shifter tool of claim 7 wherein said second drive means include:

a first retraction member operatively drivable relative to said shifter tool body to selectively engage and forcibly move said first key means from said extended position thereof to said retracted position thereof, a second retraction member operatively drivable relative to said shifter tool body to selectively engage and forcibly move said second key means from said extended position thereof to said retracted position thereof, and means for simultaneously and operatively driving said first and second retraction members.

10. The shifter tool of claim 9 wherein:

said first and second retraction members are axially and respectively locked to first and second key retainer portions of said shifter tool by frangible means operative to be broken, in response to an upward pull of said shifter tool while said first and second key means are respectively and lockingly engaged with the body and sleeve portions of the flow control device, to permit said first and second key retainer portions to be forcibly moved axially relative to the lockingly engaged first and second key means by the upward pulling of said shifter tool, and said shifter tool further comprises cooperatively interengageable ramped surface means formed on said first and second key retainer portions and their associated first and second key means and operable, in response to forcible axial movement of said first and second key retainer portions relative to their associated first and second key means, to cause said first and key retainer portions to cam said first and second key means inwardly from their extended positions to their retracted positions.

11. The shifter tool of claim 9 wherein said means for simultaneously and operatively driving said first and second retraction members include:

an electric motor, and means for operatively and drivingly coupling said electric motor to said first and second retraction members.

12. The shifter tool of claim 9 wherein:

said first retraction member has a generally tubular configuration, is coaxial with said shifter tool body, and has side wall slot means through which said first key means extend, said second retraction member has a generally tubular configuration, is coaxial with said shifter tool body, and has side wall slot means through which said second key means extend, and said means for simultaneously and operatively driving said first and second retraction members are operative to simultaneously rotate said first and second retraction members about their longitudinal axes.

13. The shifter tool of claim 12 wherein:

said first and second key means each include key members having base portions captively retained within said shifter tool body, and said side wall slot means of said first and second retraction members have tapered side edge portions configured to engage and radially inwardly cam said key member base portions in response to driven rotation of said first and second retraction members relative to said shifter tool body.

14. The shifter tool of claim 7 wherein:

said shifter tool body has a first longitudinal portion upon which said first key means are carried, and a second longitudinal portion upon which said second key means are carried, said second longitudinal portion being translatable in opposite axial directions relative to said first longitudinal portion, and said second drive means are operative to selectively drive said second longitudinal portion axially toward and away from said first longitudinal portion.

15. The shifter tool of claim 14 wherein said second drive means include:

an electric motor carried within said first longitudinal portion and drivingly coupled to said second longitudinal portion.

16. The shifter tool of claim 7 further comprising:

load cell means carried in said shifter tool body and operative to sense the magnitude of an axial driving force exerted on said second key means by said second drive means and responsively generate an electrical signal indicative of said magnitude.

17. The shifter tool of claim 7 further comprising:

potentiometer means carried in said shifter tool body for sensing the distance between said first and second key means and responsively generating an electrical signal indicative of said distance.

18. The shifter tool of claim 7 wherein:

said first drive means include spring means interposed between and operatively engaging said first and second key means and interior portions of said shifter tool, and said second drive means include:

a first retraction member operatively drivable relative to said shifter tool body to selectively engage and forcibly move said first key means from said extended position thereof to said retracted position thereof, a second retraction member operatively drivable relative to said shifter tool body to selectively engage and forcibly move said second key means from said extended position thereof to said retracted position thereof, and means for simultaneously and operatively driving said first and second retraction members.

19. The shifter tool of claim 18 wherein:

said first retraction member has a generally tubular configuration, is coaxial with said shifter tool body, and has side wall slot means through which said first key means extend, said second retraction member has a generally tubular configuration, is coaxial with said shifter tool body, and has side wall slot means through which said second key means extend, and said means for simultaneously and operatively driving said first and second retraction members are operative to simultaneously rotate said first and second retraction members about their longitudinal axes.

20. The shifter tool of claim 19 wherein:

said first and second key means each include key members having base portions captively retained within said shifter tool body, and said side wall slot means of said first and second retraction members have tapered side edge portions configured to engage and radially inwardly cam said key member base portions in response to driven rotation of said first and second retraction members relative to said shifter tool body.

21. The shifter tool of claim 20 wherein:

said shifter tool body has a first longitudinal portion upon which said first key means are carried, and a second longitudinal portion upon which said second key means are carried, said second longitudinal portion being translatable in opposite axial directions relative to said first longitudinal portion, and said second drive means are operative to selectively drive said second longitudinal portion axially toward and away from said first longitudinal portion of said shifter tool body.

22. The shifter tool of claim 21 wherein said second drive means include:

a first electric motor anchored within said first longitudinal portion of said shifter tool body, a second electric motor carried within said first longitudinal portion of said shifter tool body for axial movement relative thereto toward and away from said first electric motor, means interconnected between said first and second electric motors for moving said second electric motor axially toward and away from said first electric motor in response to operation of said first electric motor, means for coupling said second key means to said second electric motor for driven axial movement therewith relative to said shifter tool body, and means interconnected between said second electric motor and said first and second retraction members for operatively rotating them in response to operation of said second electric motor.

23. For use in conjunction with a well having a borehole sequentially extending through a spaced series of subsurface fracture zones each containing a retrievable fluid, and an elongated hollow well fluid conductor received in and longitudinally extending along the length of the borehole, a subsurface well flow control system comprising:

(a) a spaced series of well flow control devices each including:

a generally tubular body coaxially installed in the well fluid conductor at one of the fracture zones and having side wall opening means for communicating the interior of the well flow conductor with the interior of the fracture zone, the interior side surfaces of said tubular bodies having identically configured recess means formed thereon, and a tubular flow control sleeve coaxially disposed within said body for driven axial movement relative thereto between a closed position in which said sleeve covers said opening means and prevents fluid flow therethrough, and an open position in which said sleeve uncovers said opening means to permit fluid flow therethrough, the interior side surfaces of said flow control sleeves having identically configured recess means formed therein;

(b) tool means removably insertable into the well fluid conductor and, without being removed therefrom, being operable to shift any selected number of said flow control sleeves from either of said open and closed positions thereof fully to or partially toward the other of said open and closed positions thereof, said tool means including:

a hollow, generally cylindrical body portion axially movable in opposite directions through the well fluid conductor and said flow control sleeves, anchor key means carried by said tool means body portion for driven radial movement relative thereto between an extended position in which said anchor- key means project radially outwardly beyond said tool means body portion, and a retracted position in which said anchor key means are drawn radially into said tool means body portion, said anchor key means being configured to be radially and lockingly received within any of the identically configured flow control device body recess means, shifter key means carried by said tool means body portion for (1) driven radial movement relative thereto between an extended position in which said shifter key means project radially outwardly beyond said tool means body portion, and a retracted position in which said shifter key means are drawn radially into said tool means body portion, and (2) driven axial movement in opposite directions relative to said tool means body portion, said shifter key means being configured to be radially and lockingly received within any of the identically configured flow control sleeve recess means, and drive means carried within said tool means body portion and operative to (1) selectively drive said anchor key means and said shifter key means radially between said extended and retracted positions thereof and (2) selectively drive said shifter key means in opposite axial directions relative to said anchor key means; and (c) positioning means for moving said tool means body portion to selectively variable positions along the interior length of the well fluid conductor.

24. The subsurface well flow control system of claim 23 wherein said positioning means include:

a length of coil tubing connected at one end thereof to an end of said tool means body portion.

25. The subsurface well flow control system of claim 23 wherein said drive means include:

spring means carried within said tool means body portion for resiliently biasing said anchor key means and said shifter key means toward said extended positions thereof.

26. The subsurface well flow control system of claim 23 wherein said drive means include:

a first retraction member operatively drivable relative to said tool means body portion to selectively engage and forcibly move said anchor key means from said extended position thereof to said retracted position thereof, a second retraction member operatively drivable relative to said tool means body portion to selectively engage and forcibly move said shifter key means from said extended position thereof to said retracted position thereof, and means for simultaneously and operatively driving said first and second retraction members.

27. The subsurface well flow control system of claim 26 wherein:

said first retraction member has a generally tubular configuration, is coaxial with said tool means body portion, and has side wall slot means through which said anchor key means extend, said second retraction member has a generally tubular configuration, is coaxial with said tool means body portion, and has side wall slot means through which said shifter key means extend, and said means for simultaneously and operatively driving said first and second retraction members are operative to simultaneously rotate said first and second retraction members about their longitudinal axes.

28. The subsurface well flow control system of claim 27 wherein:

said first and second retraction members are axially and respectively locked to first and second key retainer portions of said shifter tool by frangible means operative to be broken, in response to an upward pull of said shifter tool while said anchor and shifter key means are respectively and lockingly engaged with the body and sleeve portions of one of the flow control devices, to permit said first and second key retainer portions to be forcibly moved axially relative to the lockingly engaged anchor and shifter key means by the upward pulling of said shifter tool, and said shifter tool further comprises cooperatively interengageable ramped surface means formed on said first and second key retainer portions and their associated anchor and shifter key means and operable, in response to forcible axial movement of said first and second key retainer portions relative to their associated anchor and shifter key means, to cause said first and key retainer portions to cam said anchor and shifter key means inwardly from their extended positions to their retracted positions.

29. The subsurface well flow control system of claim 27 wherein:

said anchor and shifter key means each include key members having base portions captively retained within said tool means body portion, and said side wall slot means of said first and second retraction members have tapered side edge portions configured to engage and radially inwardly cam said key member base portions in response to driven rotation of said first and second retraction members relative to said tool means body portion.

30. The subsurface well flow control system of claim 29 wherein:

said tool means body portion has a first longitudinal portion upon which said anchor key means are carried, and a second longitudinal portion upon which said shifter key means are carried, said second longitudinal portion being translatable in opposite axial directions relative to said first longitudinal portion, and said drive means are operable to selectively drive said second longitudinal portion axially toward and away from said first longitudinal portion.

31. The subsurface well flow control system of claim 30 wherein said drive means include;

a first electric motor anchored within said first longitudinal portion of said tool means body portion, a second electric motor carried within said first longitudinal portion of said tool means body portion for axial movement relative thereto toward and away from said first electric motor, means interconnected between said first and second electric motors for moving said second electric motor axially toward and away from said first electric motor in response to operation of said first electric motor, means for coupling said shifter key means to said second electric motor for driven axial movement therewith relative to said tool means body portion, and means interconnected between said second electric motor and said first and second retraction members for operatively rotating said first and second retraction members in response to operation of said second electric motor.

32. The subsurface well flow control system of claim 23 wherein said tool means further comprise:

load cell means carried in said tool means body portion and operative to sense the magnitude of an axial driving force exerted on said shifter key means by said drive means and responsively generate an electrical signal indicative of said magnitude.

33. The subsurface well flow control system of claim 23 wherein said tool means further comprise:

potentiometer means carried in said tool means body portion for sensing the distance between said anchor and shifter key means and responsively generating an electrical signal indicative of said distance.

* * * * *